US006749133B1

(12) United States Patent
Ketcham et al.

(10) Patent No.: US 6,749,133 B1
(45) Date of Patent: Jun. 15, 2004

(54) SPRAYING APPARATUS WITH INSERT

(75) Inventors: Craig S. Ketcham, Somerset, PA (US); Mark MacLean-Blevins, Westminster, MD (US)

(73) Assignee: Green Garden Products Company, Bedford, PA (US)

( * ) Notice: Subject to any disclaimer, the term of this patent is extended or adjusted under 35 U.S.C. 154(b) by 0 days.

(21) Appl. No.: 09/637,281

(22) Filed: Aug. 11, 2000

(51) Int. Cl.[7] ..... B05B 7/30; B05B 7/26; A62C 5/02; F23D 11/46; F23D 14/60

(52) U.S. Cl. ..... 239/318; 239/310; 239/414; 239/525; 137/894

(58) Field of Search ..... 239/318, 310, 239/414, 526, 894, 302, 308, 398, 401, 407, 415, 426, 433, 434, 537, 538, 574, 581.2; 137/894, 893

(56) References Cited

U.S. PATENT DOCUMENTS 2,719,704 A * 10/1955 Anderson et al. ..... 261/18.1
3,122,325 A * 2/1964 Mahrt et al. ..... 239/318
3,180,580 A * 4/1965 Schedel ..... 239/318
3,581,998 A * 6/1971 Roche ..... 239/415
3,940,069 A * 2/1976 Gunzel et al. ..... 239/318
4,369,921 A * 1/1983 Beiswenger et al. ..... 239/317
4,901,923 A * 2/1990 McRoskey et al. ..... 239/123
5,007,588 A 4/1991 Chow et al.
5,039,016 A * 8/1991 Gunzel et al. ..... 239/314
5,100,059 A * 3/1992 Englhard et al. ..... 239/310
5,320,288 A * 6/1994 Ketcham, Jr. ..... 239/316
5,372,310 A * 12/1994 Ketcham ..... 239/317
5,383,603 A * 1/1995 Englhard et al. ..... 239/314
5,595,345 A * 1/1997 Chura et al. ..... 239/312
6,283,385 B1 * 9/2001 Beaver et al. ..... 239/10
6,425,534 B2 * 7/2002 Ketcham et al. ..... 239/316

* cited by examiner

*Primary Examiner*—Michael Mar
*Assistant Examiner*—Darren Gorman
(74) *Attorney, Agent, or Firm*—Reed Smith LLP

(57) ABSTRACT

A substance delivery apparatus, such as a spraying apparatus, that includes an adjustment element for regulating the flow of at least one substance between at least one inlet and at least one outlet. The adjustment element is displaceable between a first position, corresponding to a first delivery condition of the at least one substance, and a second position, corresponding to a second delivery condition of the at least one substance, and the adjustment element comprises at least one sealing element for facilitating airtight fluid communication in association with at least one of the first and second delivery conditions.

28 Claims, 21 Drawing Sheets

700
736
740
738

700
715

736
737
736a 704b
704
704a
OFF
713
736
730
711
720
708
704b
704d
704a
704c
704e
VII
VII
PRODUCT FLOW
734
715
701
724
713
700
707
CARRIER STREAM FLOW

PRODUCT FLOW
CARRIER STREAM FLOW
MIX

SPRAYING APPARATUS WITH INSERT

FIELD OF THE INVENTION

The present invention relates to a spraying apparatus and especially to a multipurpose spraying, dispensing or mixing apparatus having a nozzle member.

BACKGROUND OF THE INVENTION

Liquid aspirators are commonly employed to apply diluted solutions containing chemicals such as pesticides, fungicides, herbicides, and fertilizers to lawns or garden foliage. Such aspirators are also commonly used to dispense detergents (including liquid, gelatinous and dry detergents). There are two general types of sprayers that are employed for these functions, those that use concentrated liquid chemical solutions of various viscosities, and those that utilize gelatinous substances or powdered dry chemicals. Typically, both types of sprayers are attached to a garden hose.

In the case of the liquid chemical aspiration sprayer, the pressure of the water delivered by the hose through the sprayer creates a negative pressure gradient or venturi that causes the chemical solution to be aspirated into the water stream, thereby providing a diluted solution to be sprayed.

U.S. Pat. No. 4,901,923, for example, discloses a variable dilution ratio hose-end aspirator sprayer. The sprayer comprises a container for housing the liquid to be mixed with the water and a mixing head having a nozzle at one end thereof and a garden hose attachment device at the other end thereof. The sprayer also includes a mixing chamber within the mixing head, a hose for communicating the liquid from the container to the mixing head and a disk having a plurality of apertures therein rotatably mounted in the mixing head to control flow from the container to the mixing chamber. A flow tube communicates liquid in the container to the inlet in the mixing chamber through a selected aperture in the disk so that the liquid is diluted with pressurized water at a dilution ratio determined by the size of the aperture aligned with the tube and the mixing chamber. The sprayer also includes a cleaning orifice positioned circumferential from the mixing chamber so that each aperture of the disk may be selectively aligned with the cleaning orifice for cleaning.

U.S. Pat. No. 5,039,016 also discloses an aspiration-type chemical sprayer for dispensing small quantities of a liquid-based chemical into a stream of carrier fluid. The sprayer includes a sprayer head assembly sealingly mounted onto a container for storing the chemical to be disbursed. The sprayer head assembly also includes a multifunction unitary valve for providing a range of aspiration rates simultaneously with full communication of the container interior to atmospheric pressure. The valve may also include means for positive and simultaneous closure of the aspiration and vent passages so as to seal the chemical in the container when the sprayer is not in use.

U.S. Pat. No. 5,100,059 similarly discloses an aspiration-type chemical sprayer including a sprayer head assembly sealingly mounted onto a container holding chemicals such as pesticides or fertilizers. A unitary valve in the sprayer head assembly controls carrier fluid flow from a pressurized source of water while simultaneously providing a controlled aspiration rate and full communication of the container interior to atmospheric pressure. The valve additionally includes simultaneous closure of the carrier fluid, aspiration and vent passage ways so as to seal the chemical in the container when the sprayer is not being used.

In general, the liquid chemical aspiration sprayers include a container for holding the chemical solution to be diluted and sprayed and a sprayer/mixing head. The base portion of the sprayer head serves as a cover for the chemical container. Such sprayer heads generally include an adapter for connecting the sprayer head to a standard garden hose, and a hand valve for turning on and off the flow of water from the garden hose. The sprayer head also includes an aperture over which water from the garden hose passes to mix with undiluted chemical solution from the container. Such sprayer heads may also include a venturi chamber in which the water from the garden hose mixes with the chemical from the container.

In principle, as water passes over the aperture or through the venturi chamber, a siphoning or vacuum action is created by virtue of the velocity of the water passing over the aperture or through the chamber, to draw chemical from the container into the water stream for dilution. The basis of operation of these sprayers is, in closed venturi type systems, Bernoulli's principle. And, in aspiration type sprayers open to the atmosphere, the principle under which product is drawn from the container is known as the Kuanda effect.

Liquid chemical aspiration sprayers are of two general types. Many of these sprayers have a fixed, nonadjustable dilution ratio. However, other commercially available liquid chemical aspiration sprayers provide for multiple dilution ratios. These multiple dilution ratio sprayers generally do not require chemical premixing and directly provide the desired concentration of liquid chemical into the carrier stream. The variation in the dilution ratios is generally provided in these sprayers by either varying the size of the opening of the passageway between the chemical container to the mixing chamber, or by varying the size of the vent opening which allows air into the mixing chamber in order to control the level of vacuum and the resulting siphoning action on the liquid chemical from the container. In both types of multiple dilution sprayers, a rotatable wheel or slideable stem, which incorporates orifices of various sizes, is interposed in the passageway or the vent opening and is used to select the appropriate dilution ratio.

Sprayers that are to be used for wettable chemical powders also utilize the same basic container sprayer/mixing head design as liquid chemical aspiration sprayers. But, when the water delivered from the hose enters the sprayer/mixing head, a portion of that stream is directed into the container to dissolve and dilute the wettable chemical powder therein. Once diluted, the product solution enters that portion of the water stream exiting the sprayer under the influence of the negative pressure gradient described above and by displacement of the solution within the container by incoming water.

U.S. Pat. No. 5,007,588 also discloses an aspiration-type sprayer comprising a sprayer head which is permanently attachable to a container in which additive material is received. The sprayer head may be moveable between positions controlling the degree of aspiration affected, and is provided with a cap moveable between a first position in which the cap seals the container and prevents the additive material from escaping therefrom and a second position in which the container is unsealed and aspiration of the contents thereof can take place. Elements may be provided as part of the sprayer assembly for controlling the flow of the aspirating fluid. The cap is secured in its sealing position by an element which requires special manipulating for release, thereby providing an important safety feature.

U.S. Pat. Nos. 5,320,288 and 5,372,310 each disclose an aspiration-type sprayer that is attached to a product container. This sprayer includes a control mechanism for simultaneously controlling the flow of the carrier stream through the nozzle and the chemical product. This sprayer provides the ability to spray both the chemical solution and pure carrier fluid, as well as the ability to be placed in a sealed "off" position. More particularly, the means for controlling the flow of carrier fluid can be opened while the chemical product is sealed within the container. In this sprayer, the product channel is both substantially linear and substantially reduced in length.

U.S. Pat. Nos. 5,320,288 and 5,372,310 also disclose a means to dispense a soluble solid chemical or a wettable powder. The control mechanism can be slid into a position where a portion of the carrier stream is diverted into the container to dilute the dry chemical. The resulting chemical solution then exits the container via a product channel and is placed back into the non-diverted portion of the carrier stream, again under the influence of the aforementioned negative pressure gradient and displacement with incoming water.

Typically, in the above-described sprayers, including the apparatus described in U.S. Pat. Nos. 5,230,288 and 5,372,310, product flows through one or more apertures in the valve or apparatus body and/or selection element. The selection element may be connectively engaged to the valve body. The connection between the selection element and the valve body must be airtight in order to provide a vacuum necessary for aspiration. In order to provide the airtight seal, a separate sealing means is generally provided in the form of a gasket, membrane or o-rings.

A need has been recognized in connection with the provision of a spraying apparatus, and a control arrangement therefor, that lends itself to durability and operational efficiency.

SUMMARY OF INVENTION

Various objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments therefor shown, by way of example only, in the accompanying drawings, wherein.

DETAILED DESCRIPTION OF THE INVENTION

Figure 1:
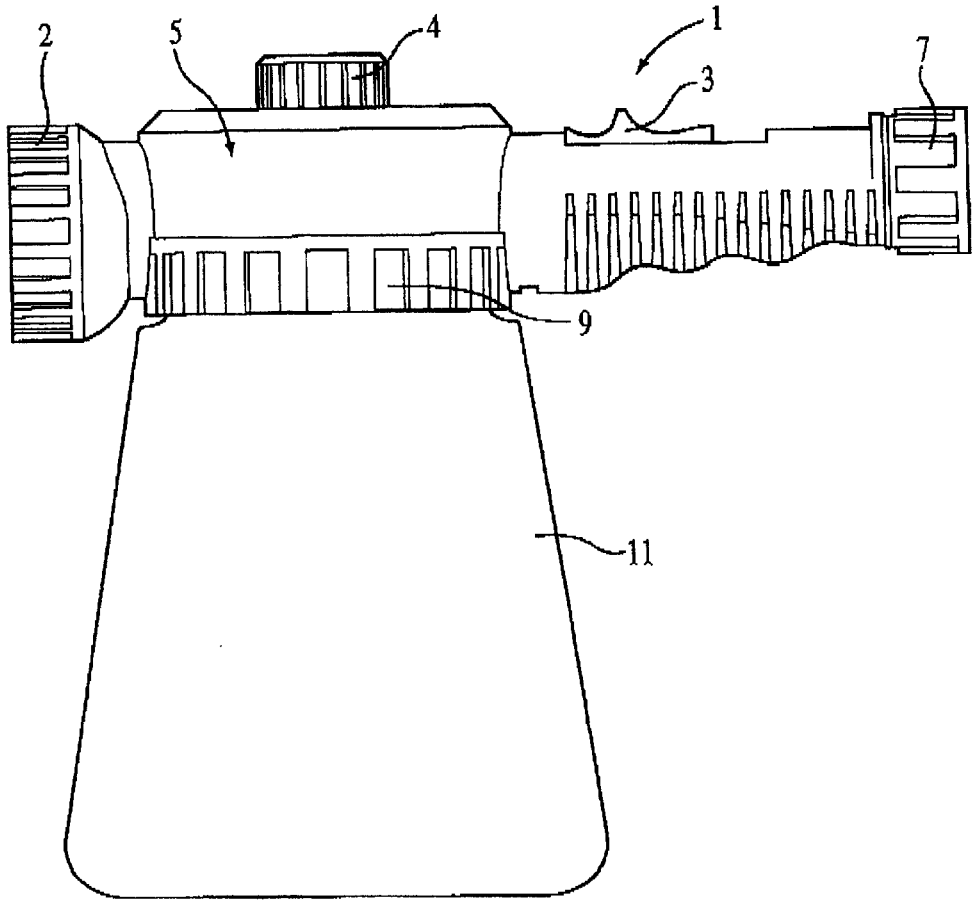
FIG. 1 is a side view of a sprayer apparatus.

Referring to the drawings, there is shown in FIG. 1 a conventional sprayer apparatus. The sprayer apparatus includes a sprayer head or housing 1 formed of rigid material such as metal or plastic and generally comprised of a cap member 5 having hose attachment means 7 and container attachment means 9. Hose attachment means 7 is typically an internally threaded member removably attachable to a hose end (not shown) for supply of a carrier stream of pressurized fluid to the cap member 5. In most applications, it is contemplated that the carrier stream fluid will be water supplied by a common garden hose (not shown). Alternatively, it is contemplated that the sprayer apparatus may be used in commercial or industrial applications with sources of carriers streams other than water, such as other liquids including chemical solvents or gaseous fluids such as air. Container attachment means 9 which may assume the form of any suitable connecting structure, e.g., threading, snaps or the like, for permanent or releasable sealing attachment of the cap member to a product container 11, the interior of which is capable of holding a chemical product to be diluted and sprayed. The chemical product can be either a liquid or a powdered solid.

Figure 2:
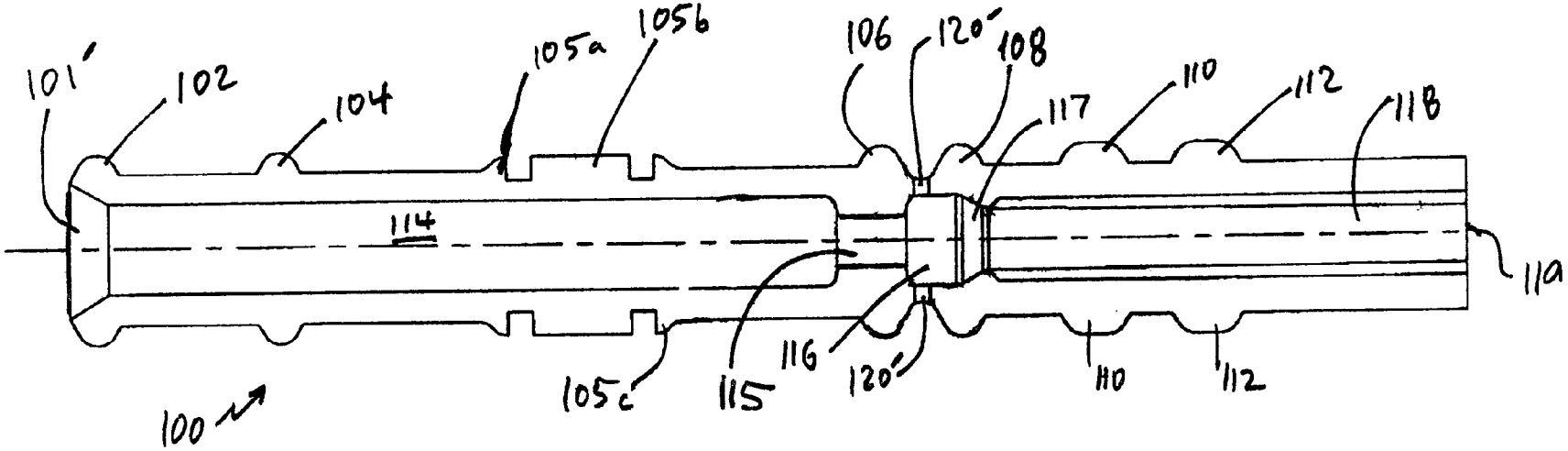
FIG. 2 is a cross-sectional side view of an insert for being employed in a sprayer apparatus or dilution apparatus.

FIG. 2 illustrates an insert 100 that may be incorporated into a spraying apparatus such as that shown in FIG. 1. Preferably, insert 100 may be formed or molded from an elastomeric material such as a natural or artificial rubber, neoprene, polyethylene or the like. Durometer measurements in the range of about 60 to about 90, and particularly in the range of about 73 to about 87, have found to be highly effective in connection with an insert 100 according to at least one embodiment of the present invention.

As shown, insert 100 is preferably tubular in nature and may include an inlet port 101' with a converging frustoconical surface. An annular projection 102 preferably circumscribes port 101'.

Proceeding further towards the right, insert 100 may bear another annular projection 104, followed by additional projections 105*a/b/c* that may be utilized, e.g., for accommodating a thumb switch or the like. Further annular projections are indicated at 106 and 108, whilst discrete protrusions, indicated at 110 and 112 may also be disposed on the external surface of the insert 100. Preferably, the protrusions 110/112 may each be four in number and may be evenly distributed about the circumference of the insert 100, i.e., at about 90 degrees apart. A suitable substitute for protrusions 110/112 may be an annular ridge (e.g., a ring) disposed about the circumference of insert 100. It should be understood that if this variant is employed, that is, the variant of an annular ridge, then a slot or other passage through the ridge may preferably be provided in order for an atmospheric vent port or hole (such as that indicated at 430 in FIG. 4B) to enjoy an open path of communication with the atmosphere.

A series of chambers are preferably defined within insert 100. A first, essentially cylindrical chamber 114 preferably extends from inlet port 101 to the vicinity of annular protrusion 106. A narrow connecting passage 115 then preferably joins chamber 114 with a much smaller cylindrical chamber 116. Chamber 116 preferably extends to a circular plane corresponding to a symmetrical cutting plane of protrusion 108 at which point it preferably transitions into a frustoconical transition portion 117. From the exit side of this transition portion 117, then, a cylindrical chamber 118 of lesser diameter preferably extends to an exit opening 119 of the insert 100.

Preferably disposed about the circumference of the insert between annular protrusions 106 and 108 are apertures 120'. As an example, there may be two such apertures 120' positioned diametrically opposite one another. They each preferably provide fluid communication between chamber 116 and the outside of insert 100, and preferably serve a function that will be better appreciated from the ensuing discussion below.

Figure 3:
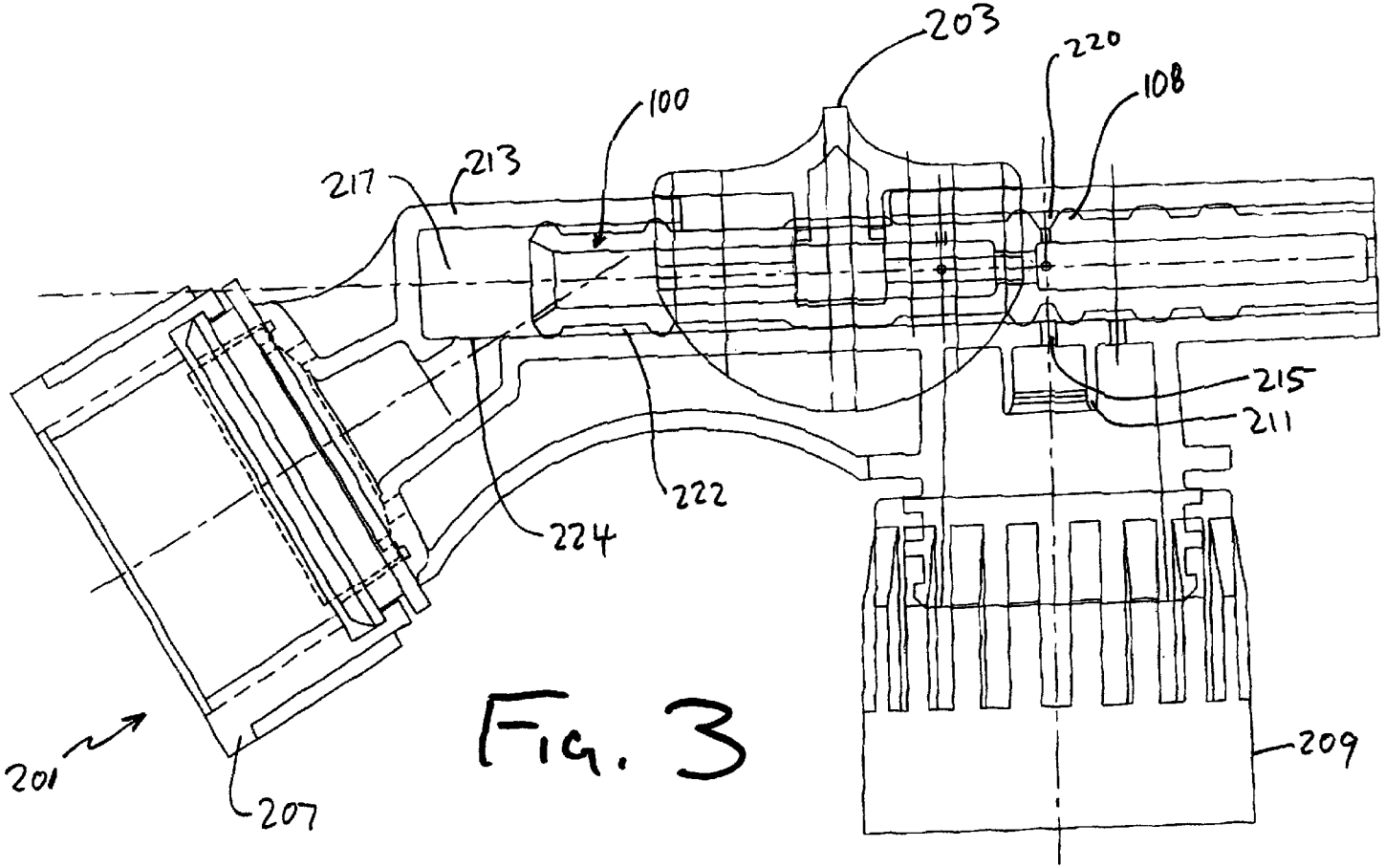
FIG. 3 is a side view of a valve body assembly containing an insert such as that shown in FIG. 2.

Illustrated in FIG. 3 is a cap member 201 that may employ an insert 100 such as that discussed above. Cap member 200 may be utilized on a container (not shown) that contains, e.g., liquid chemical for being mixed into a water stream. The water itself may be provided via a hose connection 207 where, for instance, a garden hose may be connected. Preferably, insert 100 is reciprocable and longitudinally slideable within tubular portion 213.

The insert 100 is shown as being inserted in a tubular portion 213 of cap member 201. Components of insert 100 that are not otherwise referenced in FIG. 3 are assumed, for the present discussion, to be similar to the corresponding components discussed and referenced with respect to FIG. 2.

The cap member 201 may suitably comprise, as illustrated, an outlet port 215. The port 215 is adapted for fluid communication with an essentially annular chamber 220 that is itself in fluid communication with orifices 120 of insert 100. Port 215 is also preferably in fluid communication with the upper end of a product delivery tube connection 211 which extends downwardly towards the container (not shown). As is known in the art, a suitable delivery tube may be connected to connection 211 in order to facilitate the provision of product into a water stream (as discussed below).

When insert 100 is in the position shown in FIG. 3, the apertures 120 will be in fluid communication with port 215. In this position, water from a hose (not shown) flows through a posterior portion 217 (hereinafter posterior flow passage 217) of the cap member 201, and into insert 100, first through the flow passage constriction at inlet port 100, thence through chambers 114, 116 and 118, and thence out through exit port 119. As the water passes through constricted passage 115 and into chamber 116, it passes over the aperture 120' (that is in fluid communication with outlet port 215) at high velocity, thereby creating a negative pressure gradient or venturi which causes chemical product (e.g., liquid chemical product) in the interior of the container (not shown in FIG. 3) to be drawn under suction through the product delivery connection 211, the outlet port 215, the chamber 220 and the apertures 120', where it may then enter the chamber 116 and then chamber 118. Once drawn into chamber 116 and then chamber 118, the product is then diluted to the desired concentration by the carrier fluid stream and is sprayed onto a target such as a residential lawn or garden, automobile, boat, building structural surface and the like.

A thumb switch 203 may preferably be provided to slidingly reciprocate the insert 100 within tubular portion 213. Three settings of the thumb switch 203 are conceivable in conjunction with the embodiment shown in FIG. 3. In a first position, particularly the one shown, chamber 220 will be positioned in fluid communication with outlet port 215 so as to facilitate the delivery of product via delivery tube connection 215.

In a second position, wherein annular protrusion 108 is positioned just to the left of outlet port 215, the delivery of product via delivery tube connection 215 will be prevented in that no negative pressure gradient will be provided at outlet port 215. Instead, water will travel via hose connection 207 and posterior flow passage 217 into insert 100 and out through outlet 119, without having been mixed with any product. Thus, this second position may be considered to be a "water only" position, as opposed to the first, "water/product" position discussed heretofore.

In a third position, wherein an annular chamber 222 formed between insert 100 and the inner surface of tubular portion 213 cover an outlet 224 of hose connection 207, there will be no provision of water into insert 100 as it will essentially be blocking the dedicated water passage constituted by hose connection 207. Further, there will be no fluid communication between outlet port 215 and the interior of insert 100. Thus, this third position will essentially be an "off" position, in that neither water nor product will be able to issue from cap member 200.

Preferably, insert 100 will fit into tubular portion 213 such that the annular protrusions 102, 104, 106 and 108 may be in sealing contact with the inner cylindrical surface of tubular portion 213 but still not so snugly as to preclude functionable reciprocating movement of the insert 100.

It should be understood that various components of an insert such as that described heretofore may be considered to be interchangeable with other, functionally equivalent components. For example, it is conceivable to use O-rings in place of annular protrusions 106 and 108, especially if the O-rings are firmly adhered to the rest of the insert 100. As another possible substitute for annular protrusions 106/108, one may make use of the overmolding of a sealing-type rubber compressed onto the main body of insert 100.

It is to be understood that an insert such as that described heretofore may be incorporated into a wide variety of dispensing, mixing and spraying apparatus, including apparatus for administering product and water in a gardening context. Furthermore, it should be understood that some basic principles discussed heretofore in conjunction with at least one presently preferred embodiment of the present invention may be modified to fit a variety of contexts. For example, instead of one set of orifices 120' in an insert 100, it is conceivable to provide at least one additional set of such orifices at one or more different longitudinal positions along insert 100, wherein each such additional set of orifices would be flanked by annular protrusions such as those indicated at 106 and 108 in the drawings. In such a context, each set of orifices may be of differing cross-sectional sizes so as to admit variable amounts of product into a water stream within insert 100. In this manner, it would be possible to slidingly displace insert 100 so that a chosen set of orifices, corresponding to a predetermined concentration of product, will be in fluid communication with the product supply.

The disclosure now turns to the balance of the figures, which variously illustrate alternative embodiments contemplated within the scope of the present invention. In each remaining figure, any components similar to those found in any figure previous thereto (other than FIG. 1) will have reference numerals advanced by a multiple of 100.

Figure 4A:
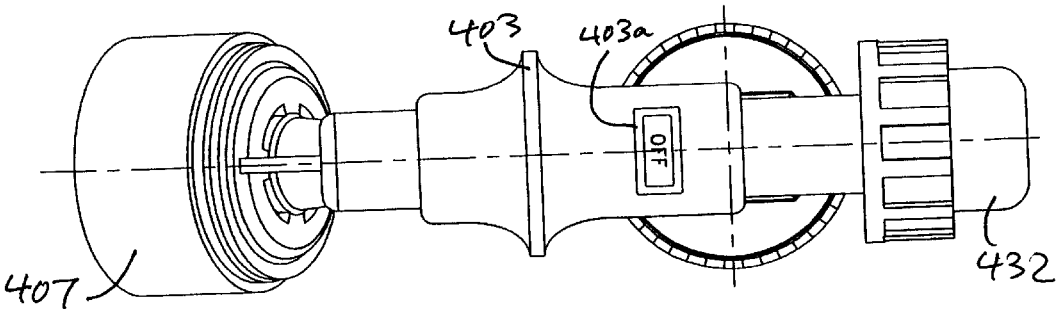
FIGS. 4A and 4B respectively illustrate top and side views of a variant valve body assembly embodiment also containing an insert such as that shown in FIG. 2.
Figure 4B:
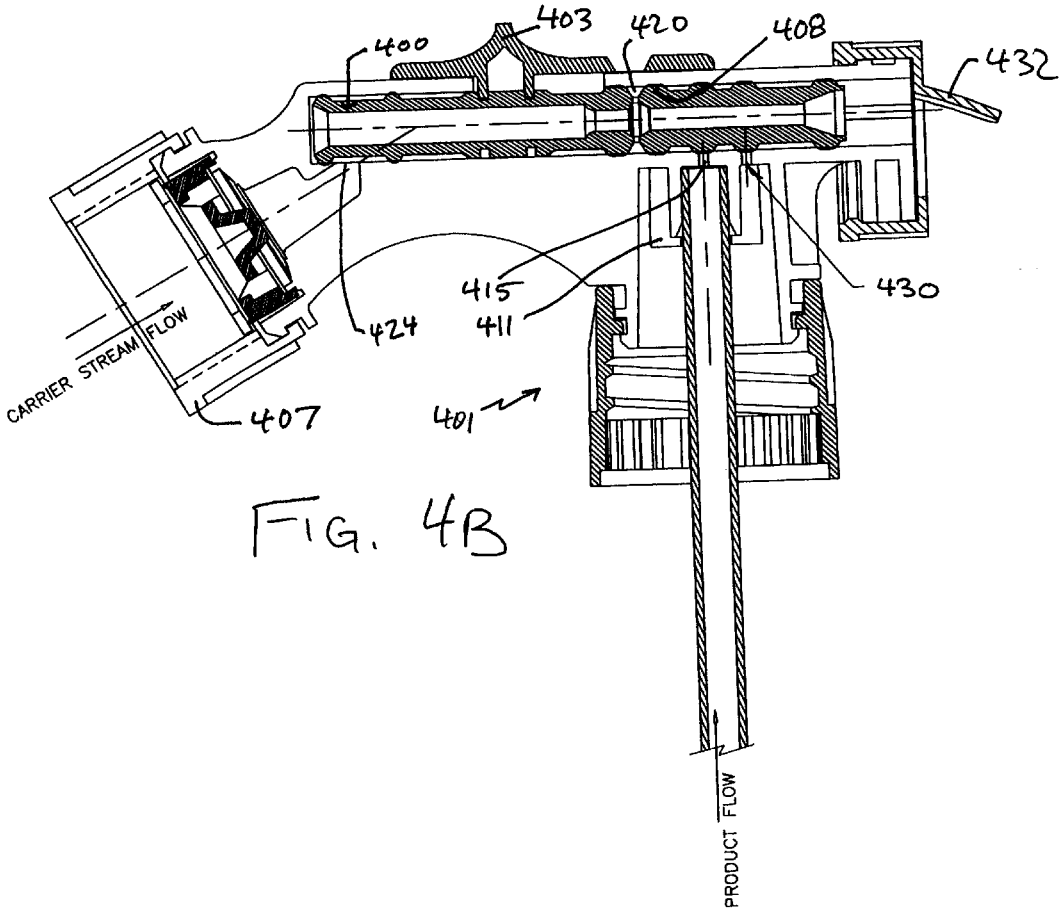

FIGS. 4A and 4B, respectively, show a top and side view of a cap member 401 in which a thumb switch 403 is included along with a deflector element 432. Deflector element 432 will preferably serve to assist in producing a diffuse spray, such as may be appropriate for lawn and garden applications, as opposed to a straight stream (that would normally result in the absence of a deflector), such as may be appropriate for, e.g., a window washing application. Deflector element 432 will preferably be angled in a manner appropriate for producing the aforementioned diffuse spray.

In FIGS. 4A and 4B, the thumb switch 403 is in an "off" position, in which no water may enter insert 400 from lose connection 407 and, with the atmospheric vent hole 430 closed, no product may issue from an attached bottle (not shown). Preferably, thumb switch 403 includes a window 403*a* through which the current state of product mixing (e.g., "OFF", "$H_2O$", "MIX" relating to no water/no product, water only, and mixed water and product, respectively) may be displayed, as shown.

Figure 4C:
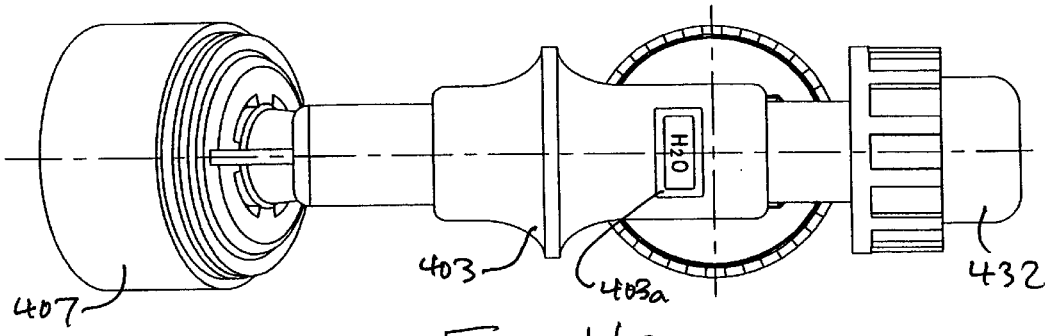
FIGS. 4C and 4D are essentially the same views as FIGS. 4A and 4B, respectively, but showing the insert in a second longitudinal position.
Figure 4D:
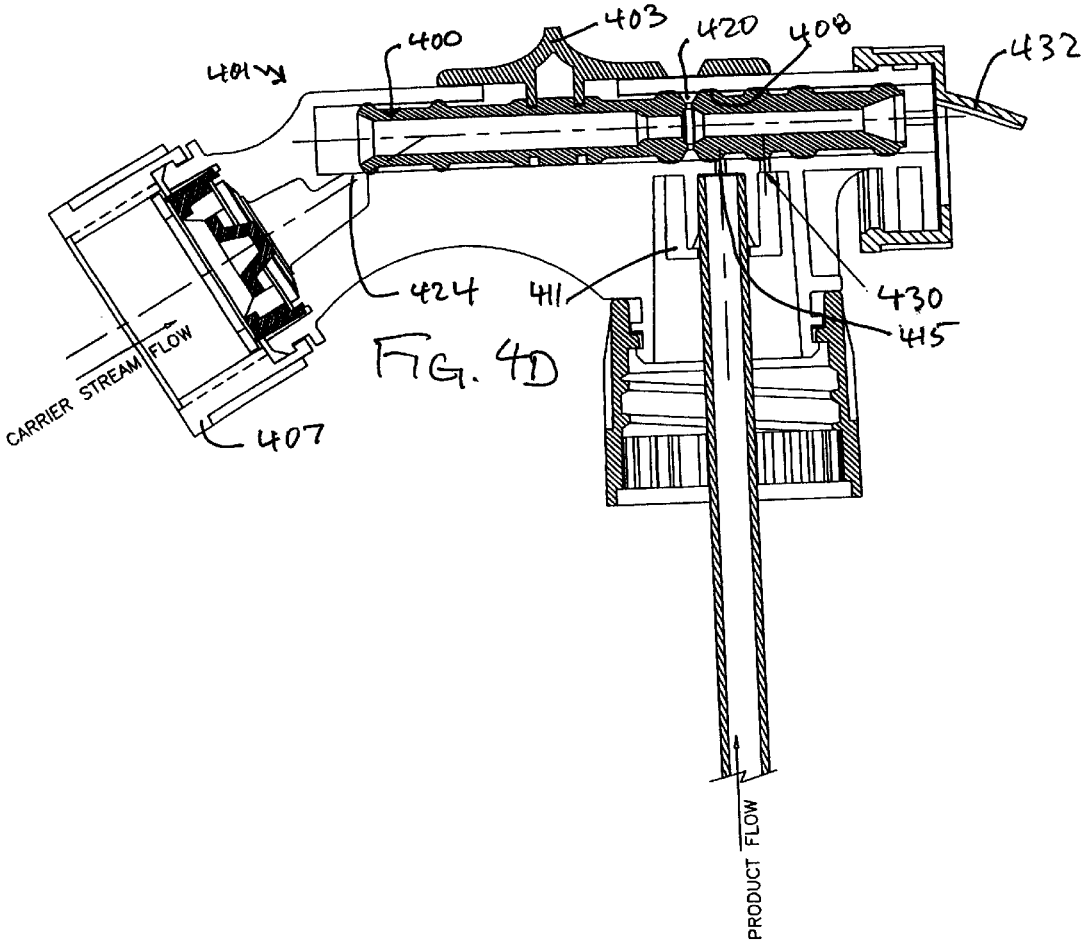

FIGS. 4C and 4D are substantially the same views as FIGS. 4A and 4B, respectively, but show thumb switch 403 in a position in which only water, but no product, is admitted into the interior of insert 400.

Figure 4E:
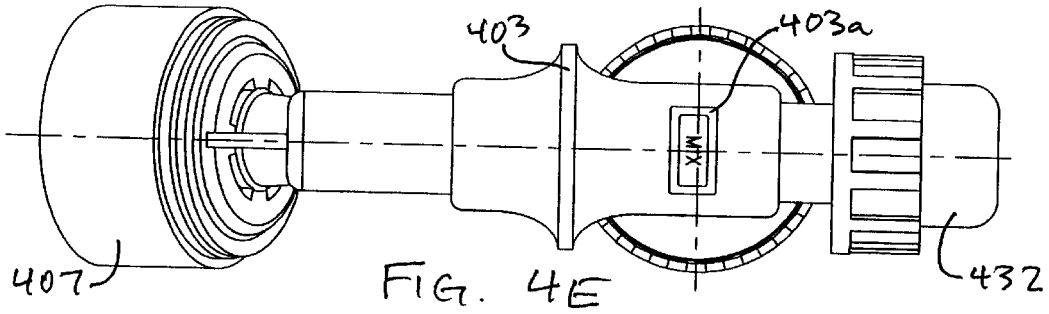
FIGS. 4E and 4F are essentially the same views as FIGS. 4A and 4B, respectively, but showing the insert in a third longitudinal position.
Figure 4F:
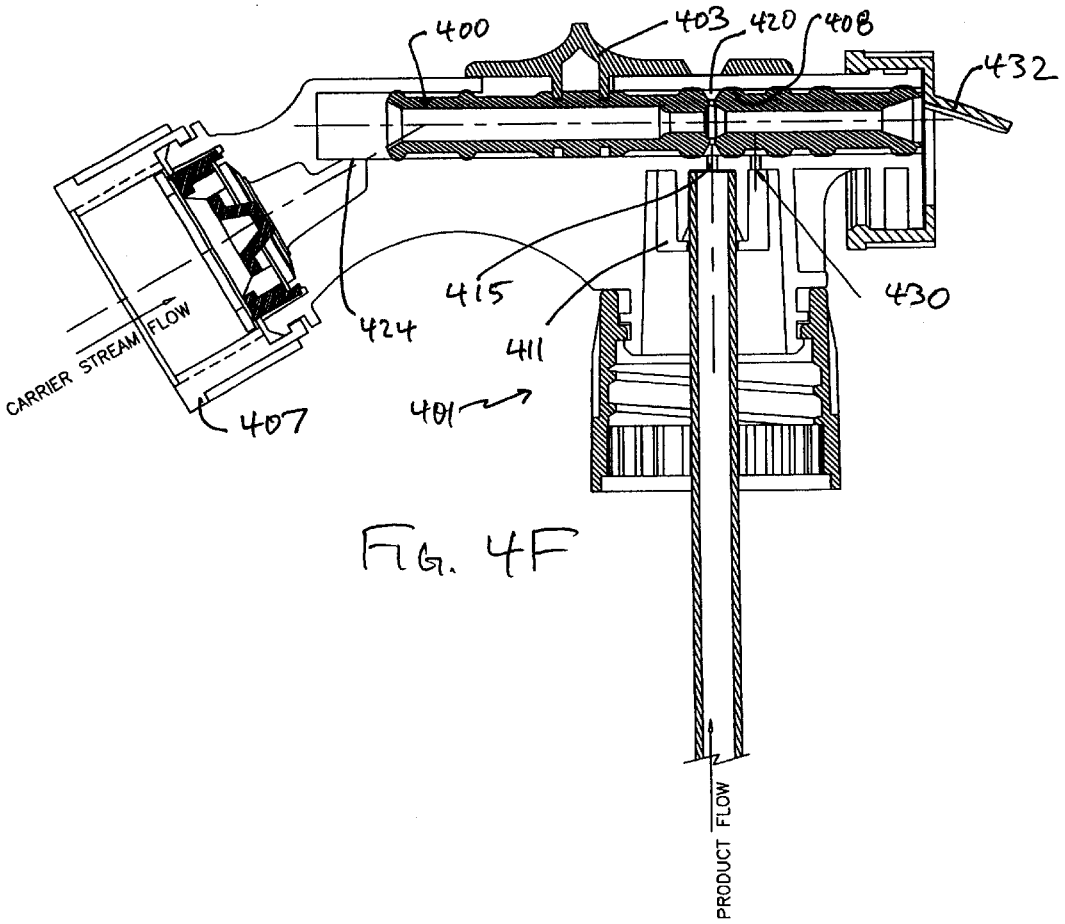

FIGS. 4E and 4F are substantially the same views as FIGS. 4A and 4B, respectively, but show thumb switch. 403 in a position in which a mixture of both water and product are admitted into the interior of insert 400. Thus, in this case, water may enter insert 400 from lose connection 407 while, with atmospheric vent hole 430 open and annular chamber 420 positioned over port 415, product is free to enter insert 400 from an attached bottle (not shown).

FIGS. 5A–5F, respectively, correspond substantially to FIGS. 4A–4F, but represent an embodiment in which a deflector element (such as the one indicated at 432 in FIGS. 4A–4F) is not included.

FIGS. 6A–6F represent views, and states of product mixing (i.e., "OFF", "$H_2O$", "MIX") corresponding substantially to those illustrated in FIGS. 4A–4F, respectfully, with the difference that a thumb switch (such as that indicated at 403 in FIGS. 4A–4F) is replaced by a rotating knob actuator 604. As with the embodiment of FIGS. 4A–4F, knob actuator 604 includes a window 604*a* through which the state of product mixing (e.g., "OFF", "$H_2O$", "MIX") may be displayed. As shown, knob actuator 604 preferably includes a relatively flat gripping knob 604*b*, while the body 604*c* extending therefrom is preferably guided rotationally within a partly cylindrical housing 604*d*. Preferably included on rotatable body 604*c* are gear teeth 604*e* that are adapted to mesh with a compatible toothed rack 634 that is integrally molded on the exterior of insert 600. Thus, rotation of knob actuator 604 will translate to sliding action of insert 600. Preferably, the physical parameters of knob actuator 604 and insert 600 will be so configured as to result at least in three stages of product mixing (i.e., "OFF", "$H_2O$", "MIX") as illustrated in FIGS. 6A–6B, 6C–6D and 6E–6F, respectively.

As in the embodiment of FIGS. 4A–4F, a deflector element, indicated at 632, is preferably included and performs the same function as that indicated at 432 in FIGS. 4A–4F. Alternatively, however, the deflector element may be left out (as in the embodiment of FIGS. 5A–5F).

Figures 7A, 7B, 7C, 7D:
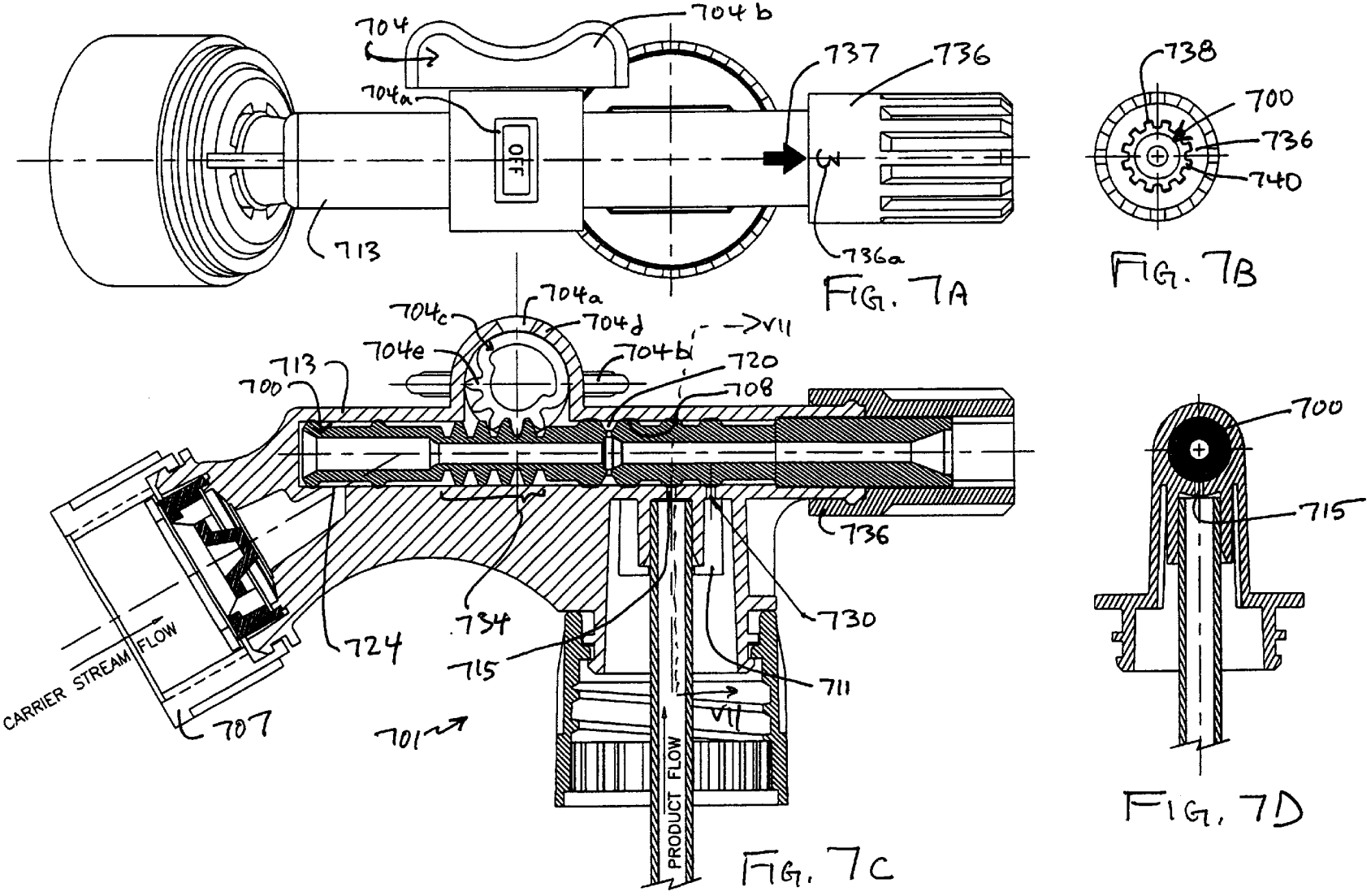
FIG. 7A is a top view of another valve body assembly embodiment.
FIG. 7B is an end view of a portion of the assembly shown in FIG. 7A.
FIG. 7C is a side view of the assembly shown in FIG. 7A.
FIG. 7D is a cross-sectional end view taken through line VII—VII in FIG. 7C.
Figure 7F:
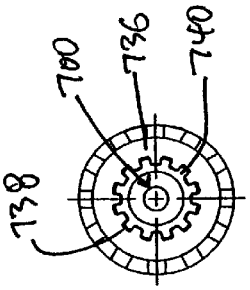
FIGS. 7E–7H illustrate substantially the same views as FIGS. 7A–7D, but correspond to a second longitudinal position of the insert.
Figure 7H:
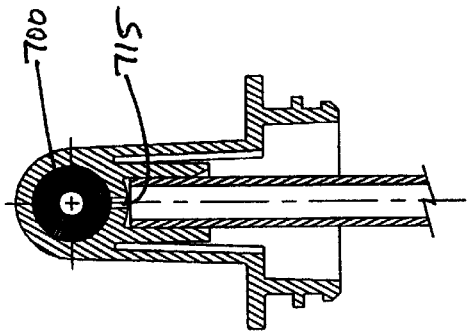
Figure 7E:
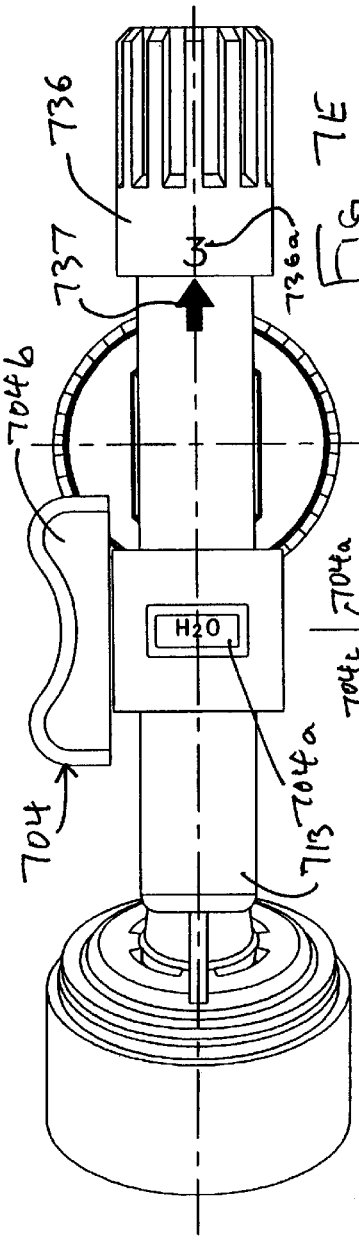
Figure 7G:
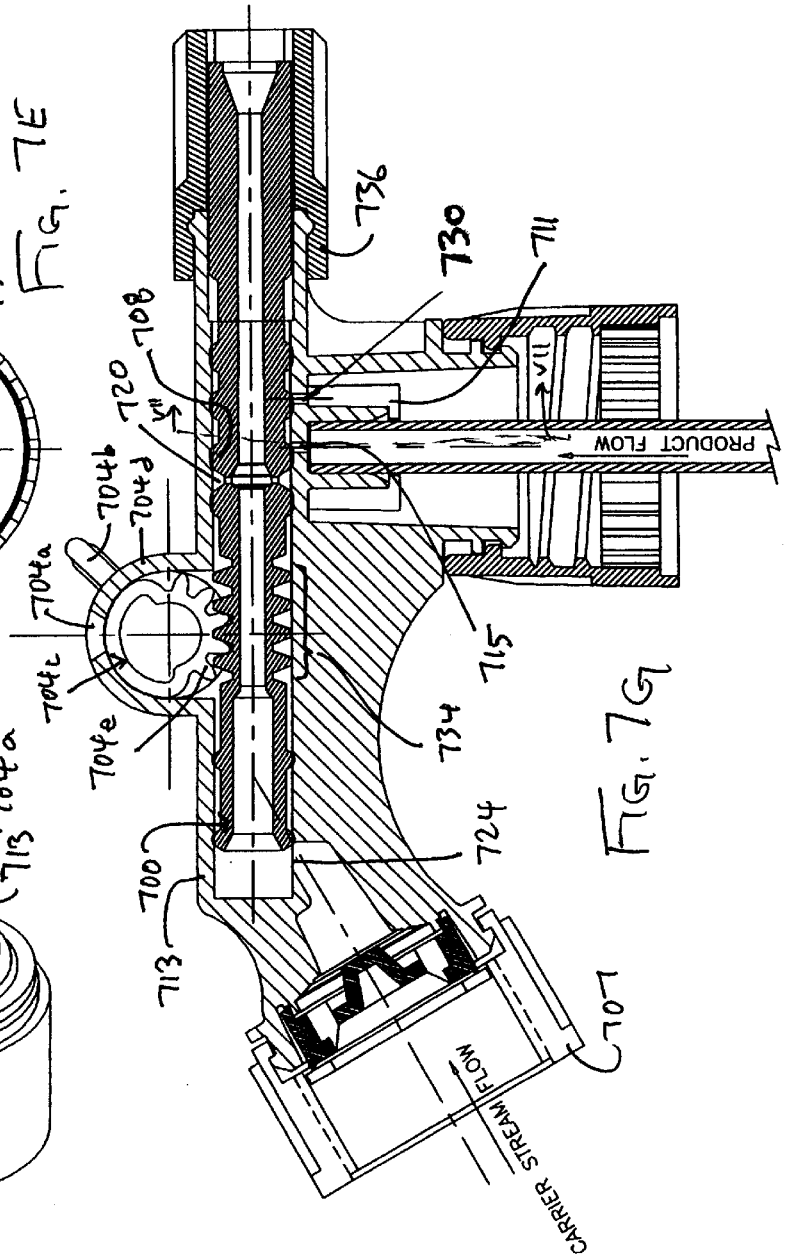
Figures 7J, 7K, 7L, 7M, 7N:
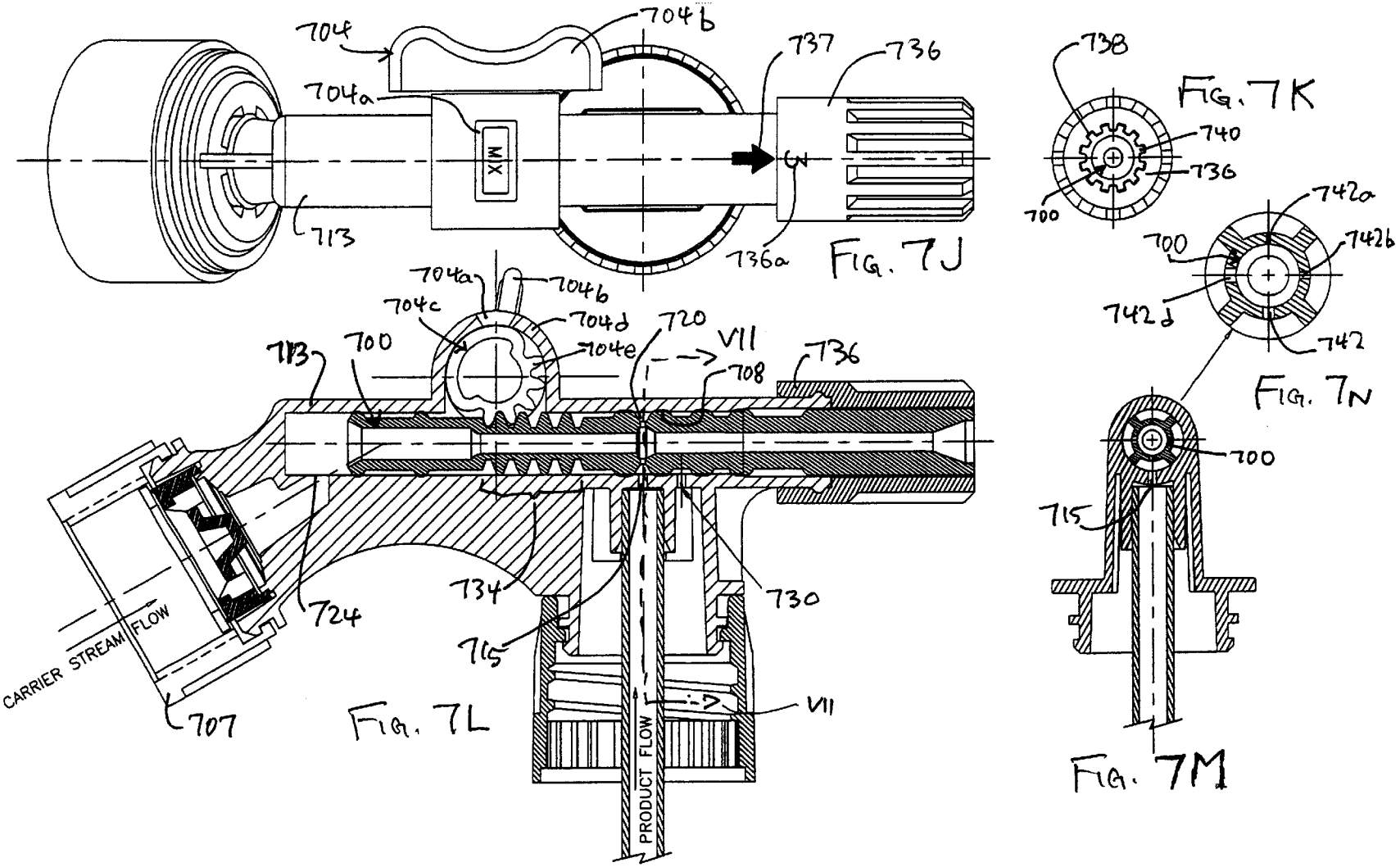
FIGS. 7J–7M illustrate substantially the same views as FIGS. 7A–7D, but correspond to a third longitudinal position of the insert.
FIG. 7N is an enlarged view of a portion of the view in FIG. 7M.

FIGS. 7A–7N relate to a concept in which an insert may be rotated as well as translated. As shown in FIGS. 7A and 7C, there may be an adjustment knob 704 similar to the embodiment of FIGS. 6A–6F. This, as before, will preferably reciprocably translate insert 700 along a longitudinal direction. However, a second adjustment knob 736 may also be provided, preferably at the end of the sprayer head as shown, for rotating insert 700. Preferably, a graduated numerical scale 736*a* (e.g., indicating numerals 1, 2, 3, 4) will be provided on knob 736*a* which, in conjunction with an arrow 737 on the main body tubular body portion, 713 will indicate a relative rotational position of the insert 700. It will be understood that the teeth 734 of insert 700 will preferably be freely rotatable with respect to the teeth 704*e* of rotatable body 704*c*.

FIG. 7B is an end view showing knob 736 and insert 700. To transfer rotational displacement from knob 736 to insert 700, there are preferably internal teeth 738 on knob 736 that compatibly mesh with external teeth 740 on insert 700.

FIG. 7D is a cross-sectional view taken along line VII—VII of FIG. 7C. FIGS. 7A–7D relate to an "OFF" state in which no water nor product enters the interior of insert 700.

FIGS. 7E–7H, on the other hand, correspond substantially to the views shown in FIGS. 7A–7D but instead show a state in which water only enters the interior of insert 700. As in the state illustrated in FIGS. 7A–7D, the rotational position of insert 700 that is established via knob 736 is of little consequence.

However, FIGS. 7J–7M, which show substantially the same views as FIGS. 7A–7D, respectively, illustrate a state in which both water and product enter the interior of tube 700. It is here that the significance of knob 736 becomes apparent. Particularly, as illustrated in FIG. 7M as well as in a corresponding close-up in FIG. 7N, there are preferably four different apertures 742*a*/*b*/*c*/*d*, respectively, for admitting progressively greater flows of product into the interior of insert 700. Thus, by rotating knob 736, it is possible to adjust the strength of the product/water mixture, progressing from a weaker solution (corresponding to aperture 742*a*) to a stronger solution (corresponding to aperture 742*d*), with apertures 742*b* and 742*c* representing intermediate steps between the two extremes. As shown, knob 736, in conjunction with markings 736*a* and 737, will preferably ensure that a corresponding aperture 742*a*/*b*/*c*/*d* is positioned above the port 715. In FIGS. 7J–7N, the second largest aperture 742*c* is positioned above port 715 to admit the second highest possible product concentration.

Although only four different possible product/water concentrations are afforded by the embodiment illustrated in FIGS. 7A–7N, it is to be understood that any conceivable number of distinct ratios may be afforded within the physical parameters at hand, including the specific diameters used for the insert 700 and the tubular body portion 713.

Figure 8A:
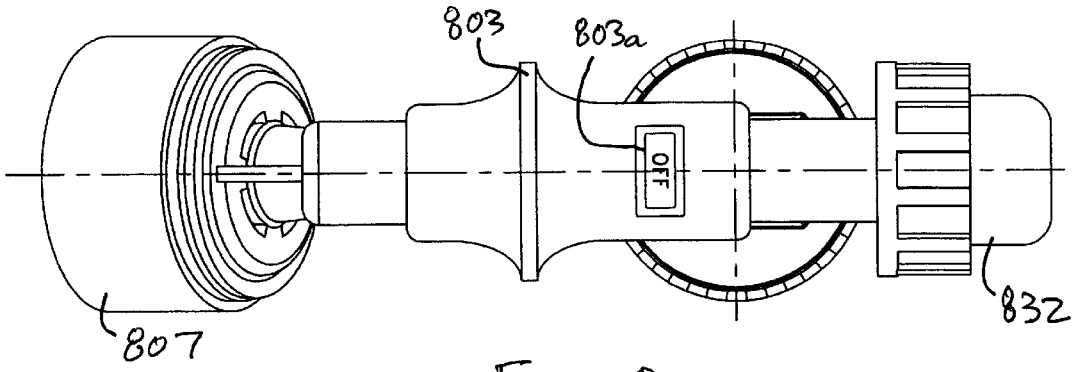
FIGS. 8A and 8B respectively illustrate top and side views of a variant valve body assembly embodiment also containing an insert such as that shown in FIG. 2.
Figure 8B:
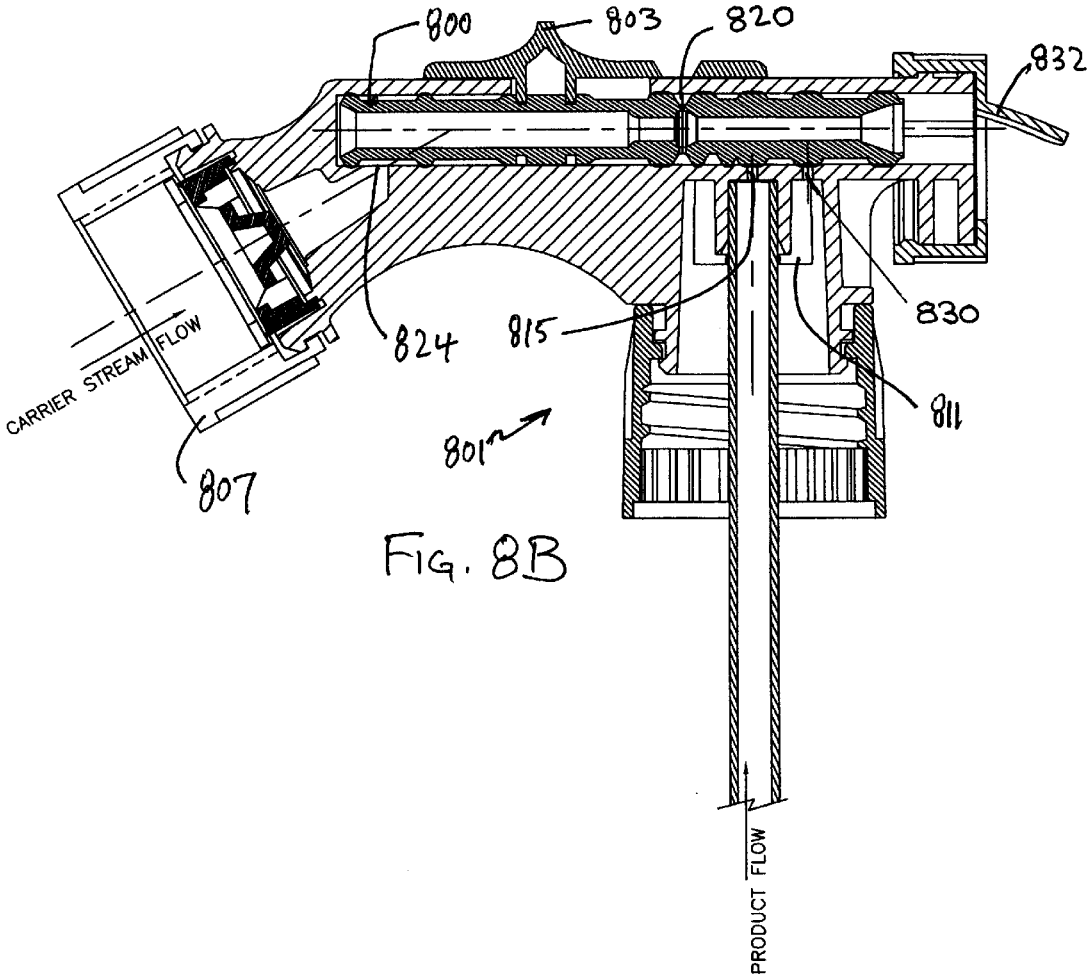
Figure 8C:
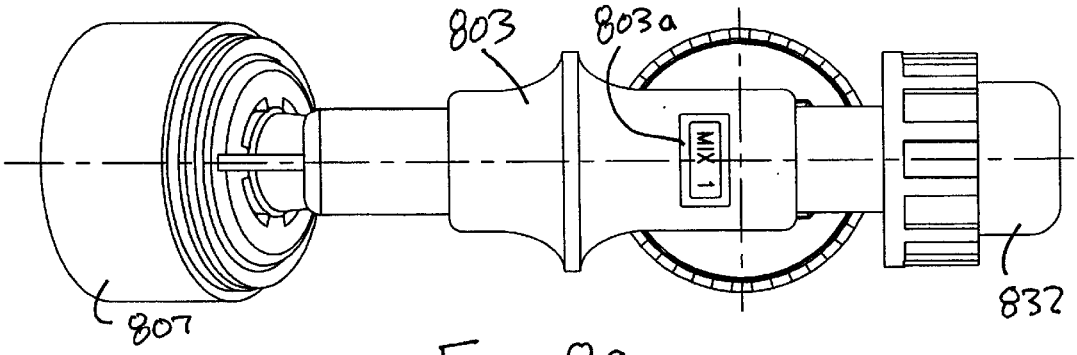
FIGS. 8C and 8D are essentially the same views as FIGS. 8A and 8B, respectively, but showing the insert in a second longitudinal position.
Figure 8D:
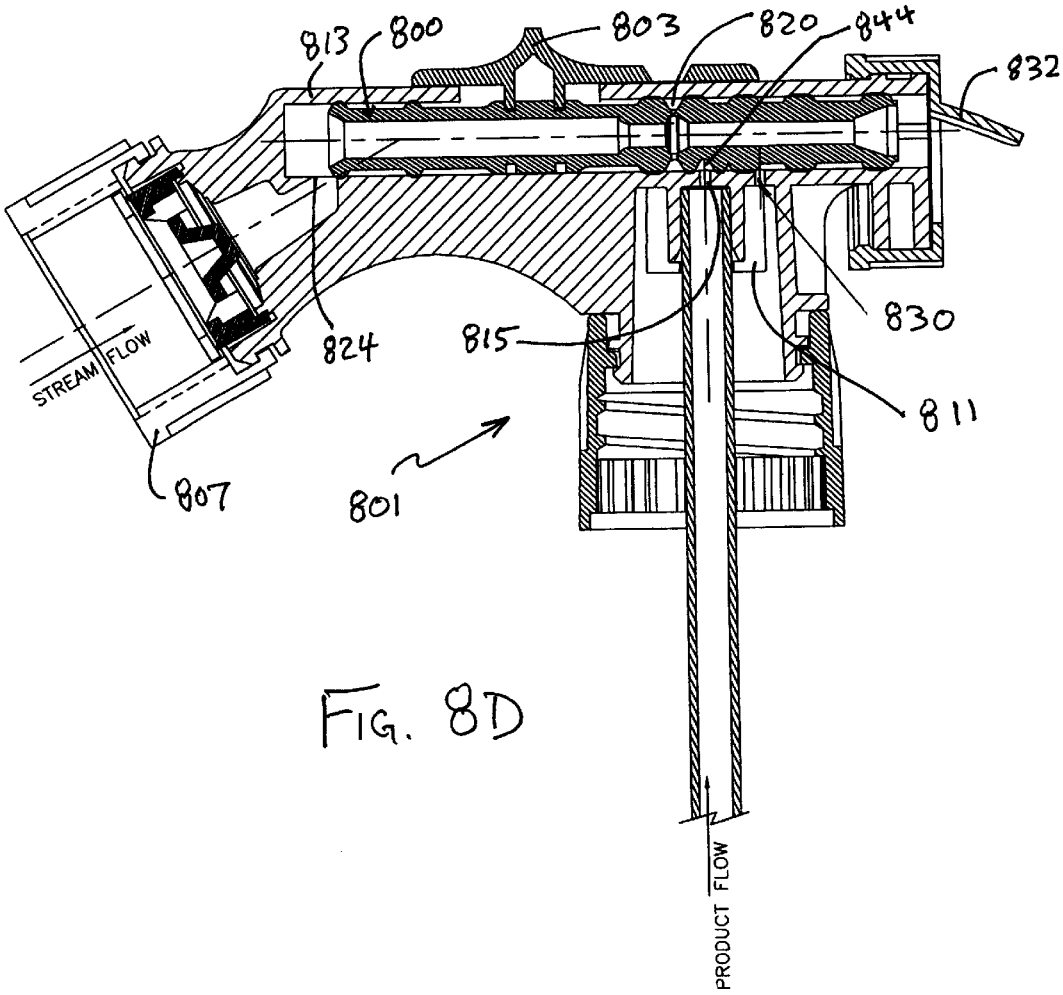
Figure 8E:
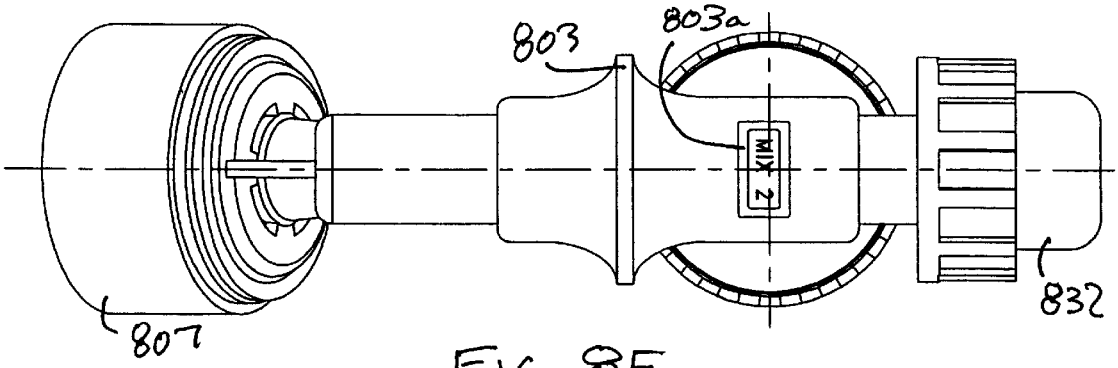
FIGS. 8E and 8F are essentially the same views as FIGS. 8A and 8B, respectively, but showing the insert in a third longitudinal position.
Figure 8F:
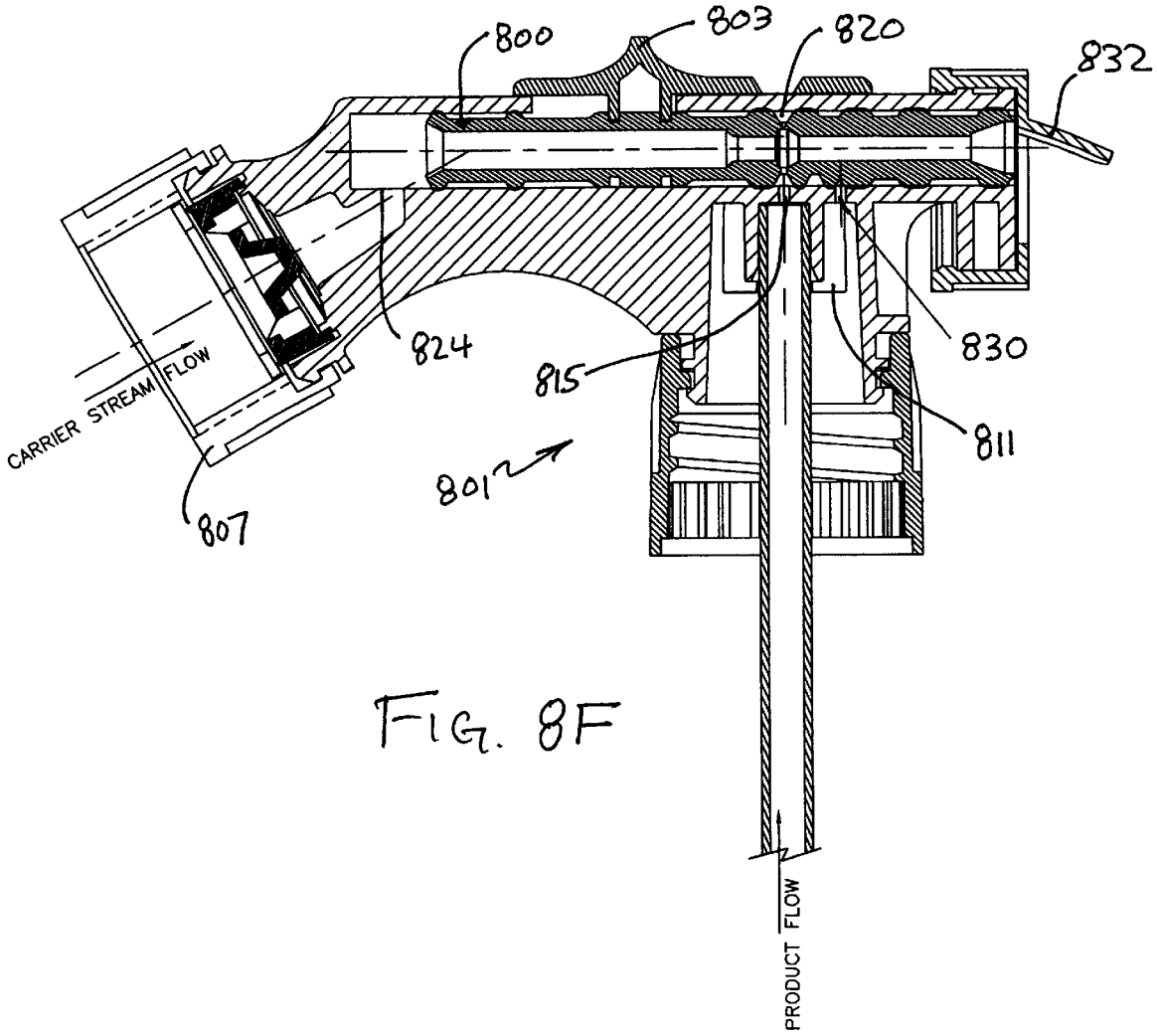

FIGS. 8A–8F illustrate an embodiment similar to that shown in FIGS. 4A–4F. Particularly, a thumb switch 803 is included for reciprocably sliding the insert. 800. However, the primary difference borne by the embodiment of FIGS. 8A–8F, in comparison to that of FIGS. 4A–4F and other embodiments disclosed hereinabove, is that the capability is afforded of providing two ratios of product-to-water via strictly linear actuation of the insert 800. FIGS. 8A and 8B illustrate an "OFF" position while, instead of a "water only" ("$H_2O$") position, FIGS. 8C and 8D illustrate a "MIX 1" position. FIGS. 8E and 8F, on the other hand, illustrate a "MIX 2" position that affords a different product-to-water ratio than the position contemplated by FIGS. 8C and 8D.

Figure 8G:
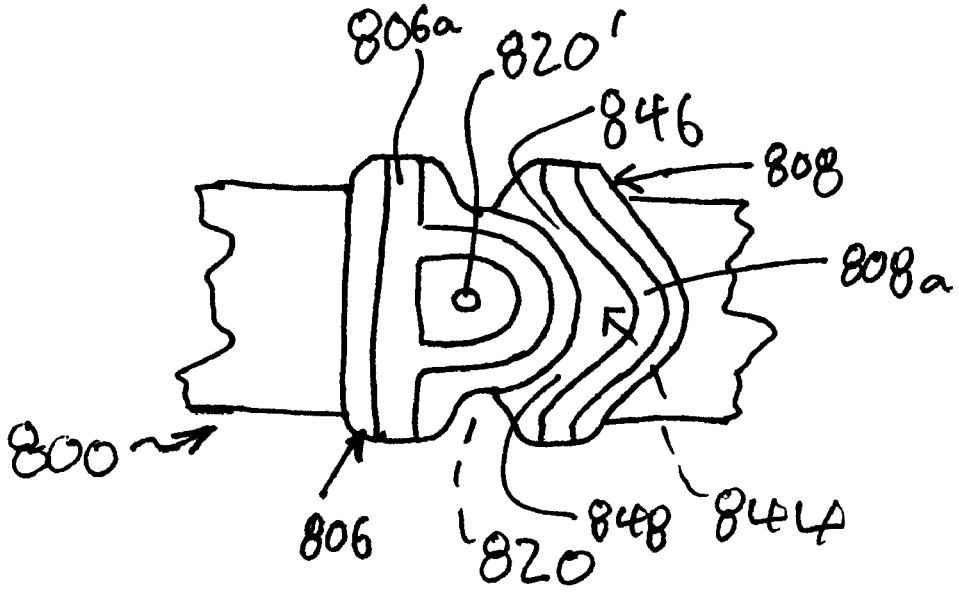
FIG. 8G is a bottom view, in isolation, of an insert utilized in conjunction with FIGS. 8A–8F.

As shown in FIG. 8D, the "MIX 1" position involves not only the admission of water through hose connection outlet 824 but also the admission of product via a chamber 844 of limited size. The configuration and significance of chamber 844 can be better appreciated with simultaneous reference to FIG. 8G, which is a bottom view of insert 800 in isolation. As shown, the chamber 844 positioned above port 815 will preferably admit product (when the insert 800 is positioned longitudinally as shown in FIG. 8D) that is thence diverted via passages 846 and 848 to the annular chamber 820.

As shown, sealing surfaces 806*a* and 808*a*, which will sealingly contact the inner surface of tubular housing portion 813, preferably define therebetween the chambers 820 and 844. In the present embodiment, however, at least one orifice 820' is preferably surrounded by a looping portion of sealing surface 806*a* (as shown) so as to preclude the entry of product into the illustrated orifice 820' when the insert 800 is in the longitudinal position shown in FIG. 8D. Rather, product will preferably progress from chamber 844 through passages 846 and 848 into annular chamber 820 and thence into one or more other orifices (not shown) disposed somewhere along the circumference of insert 800 in communication with annular chamber 820. For instance, one such orifice, configured for admitting product into the interior of insert 800 when the insert 800 is in the longitudinal position shown in FIG. 8D, may be diametrically opposite from the orifice 820' shown in FIG. 8G (and, in contrast to the orifice 820' shown, in unimpeded fluid communication with annular chamber 820). It will be appreciated that such a configuration will result in a smaller ratio of product-to-water than with the longitudinal position of insert 800 shown in FIGS. 8E and 8F.

Figure 5A:
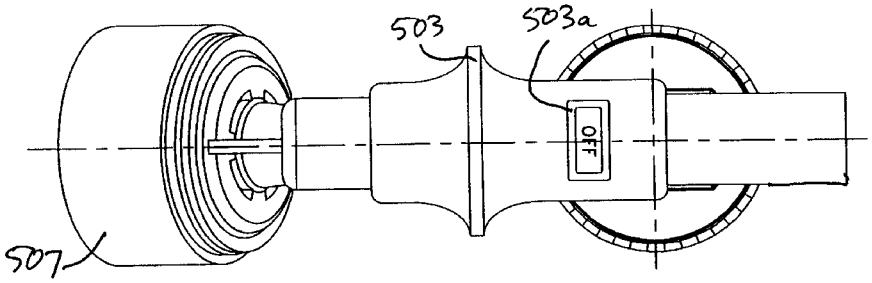
FIGS. 5A–5F illustrate an embodiment of a valve body assembly in views substantially the same as those shown in FIGS. 4A–4F, respectively.
Figure 5B:
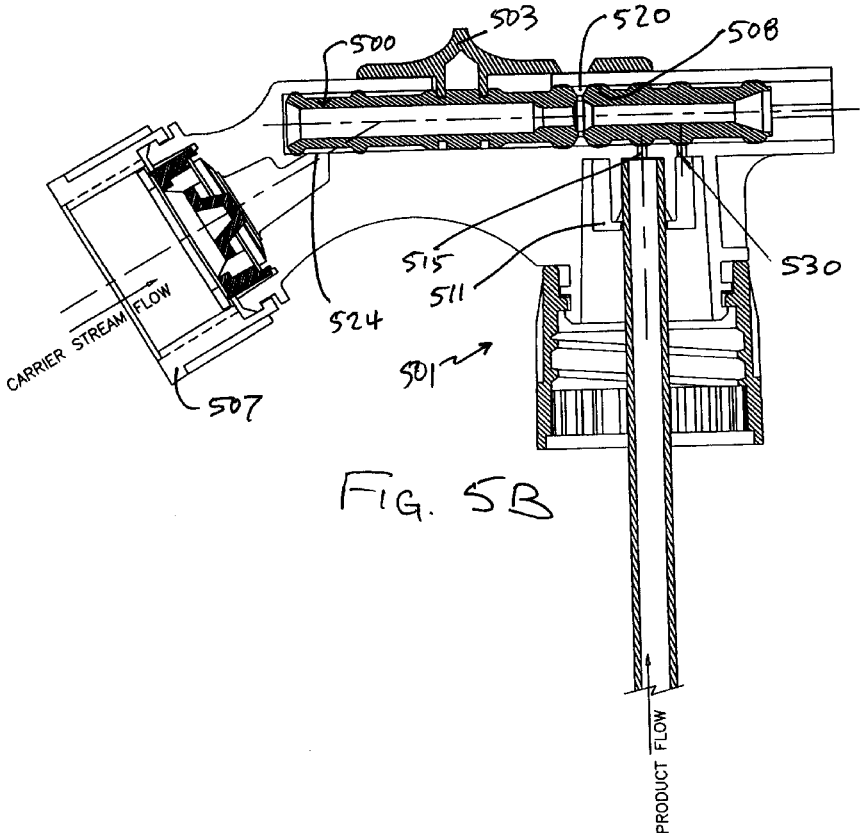
Figure 5C:
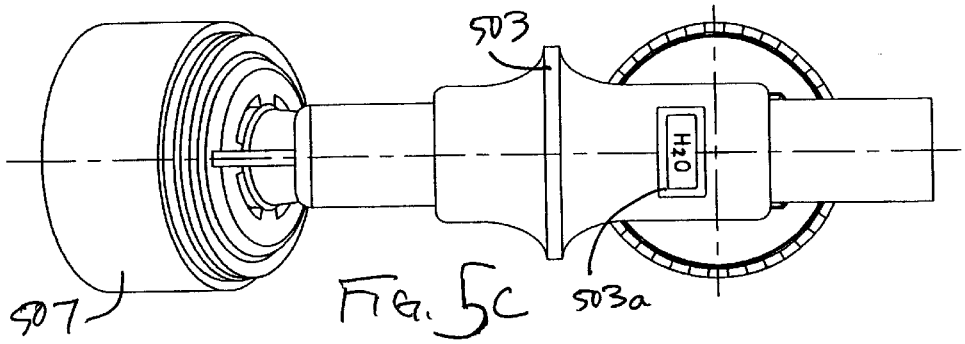
Figure 5D:
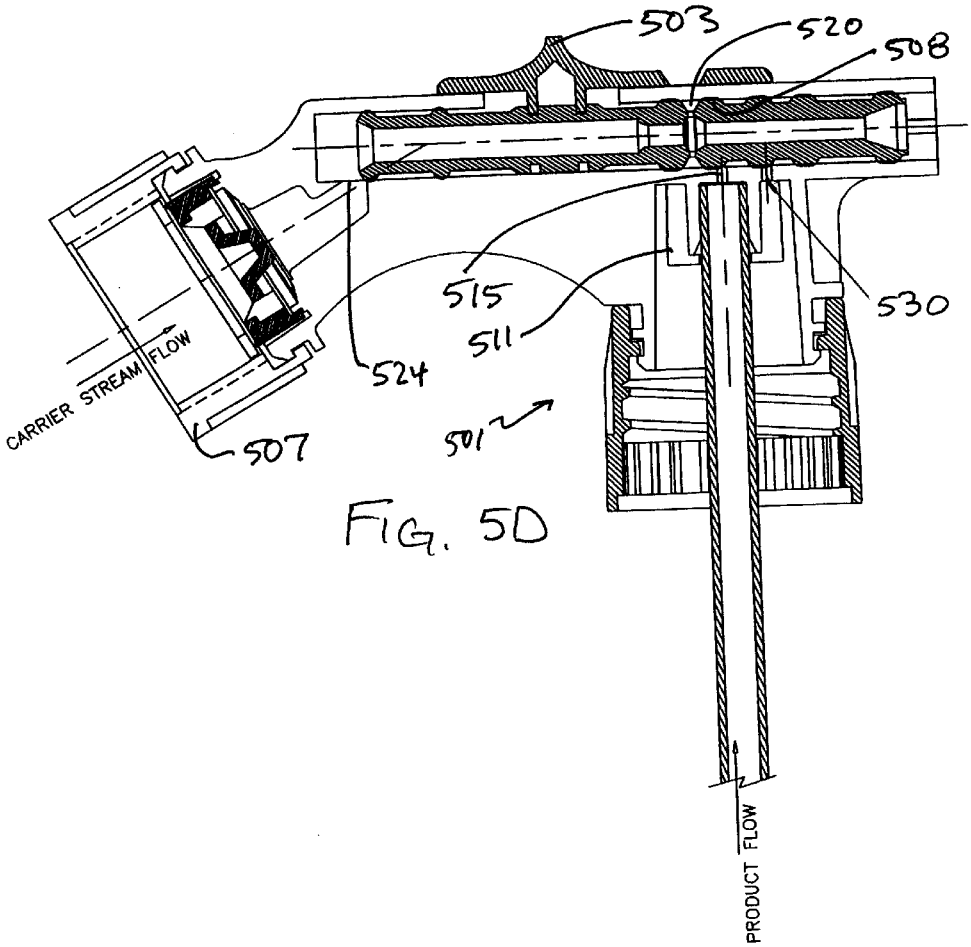
Figure 5E:
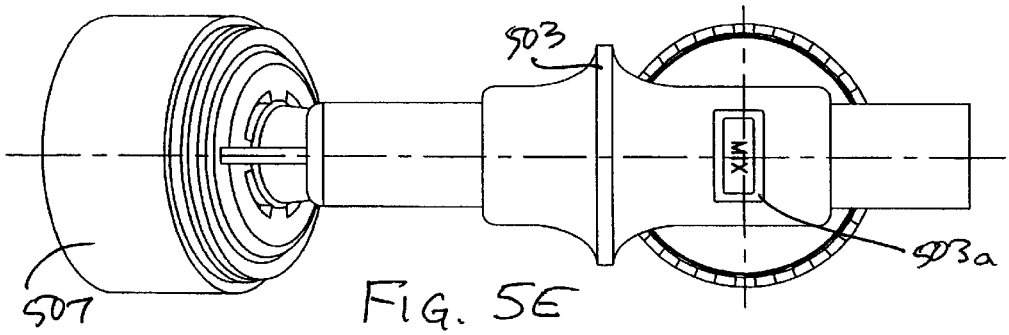
Figure 5F:
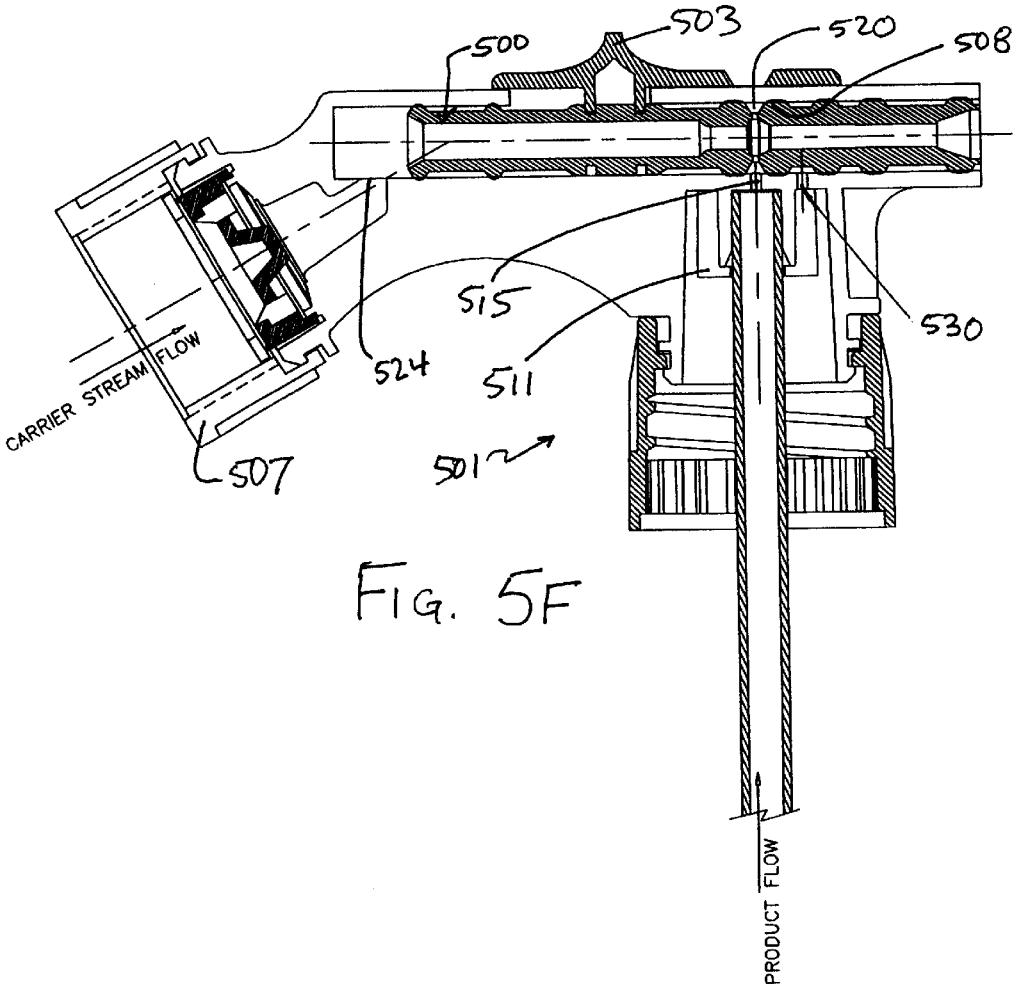
Figure 6A:
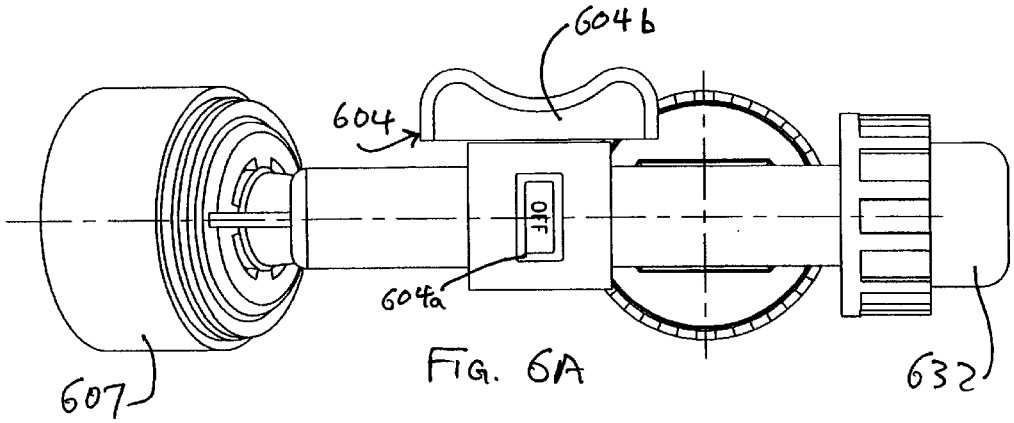
FIGS. 6A–6F illustrate another embodiment of a valve body assembly in views substantially the same as those shown in FIGS. 4A–4F, respectively.
Figure 6B:
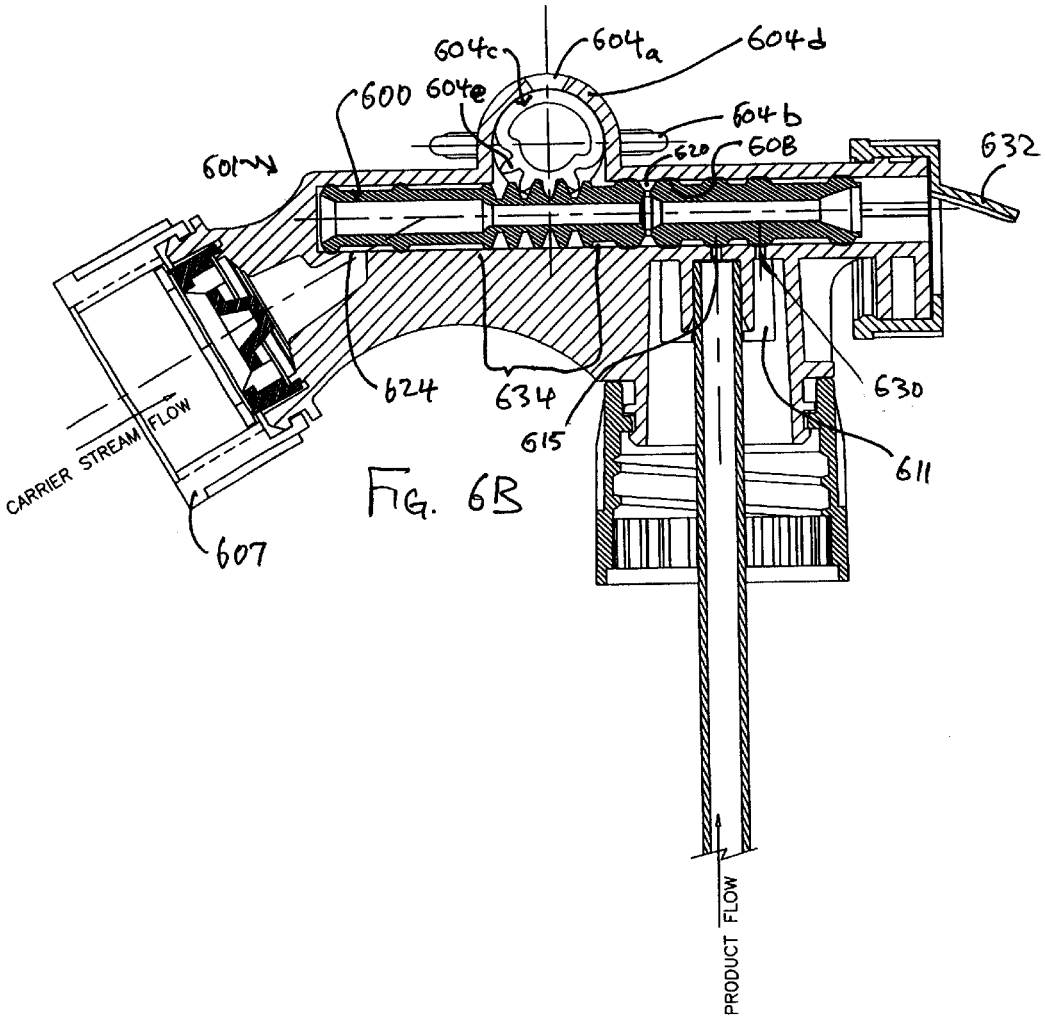
Figure 6C:
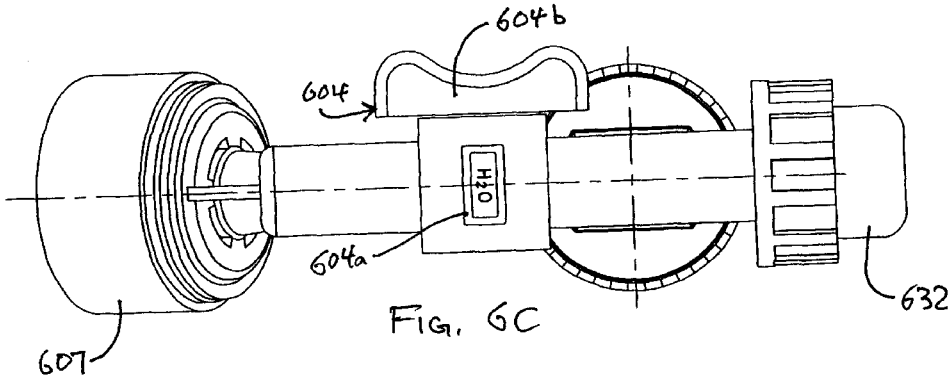
Figure 6D:
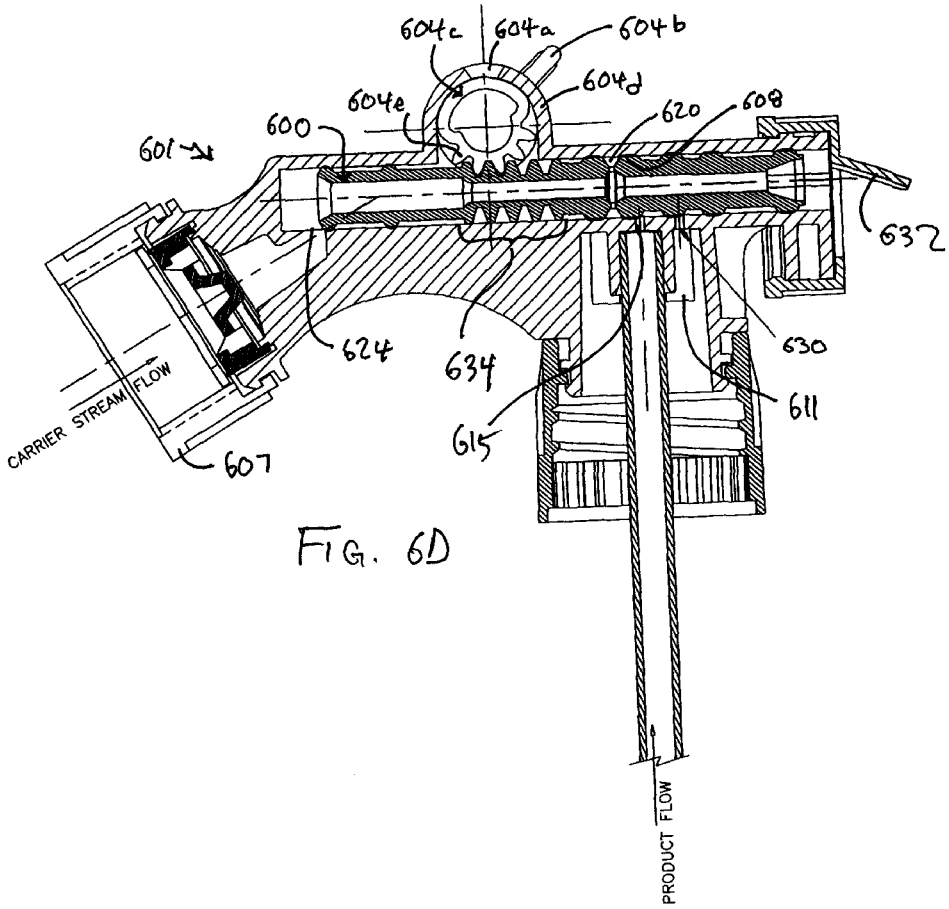
Figure 6E:
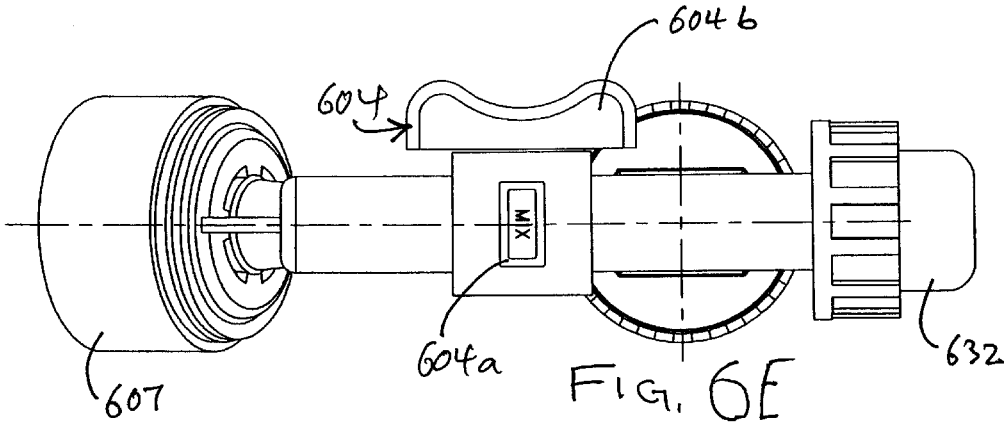
Figure 6F:
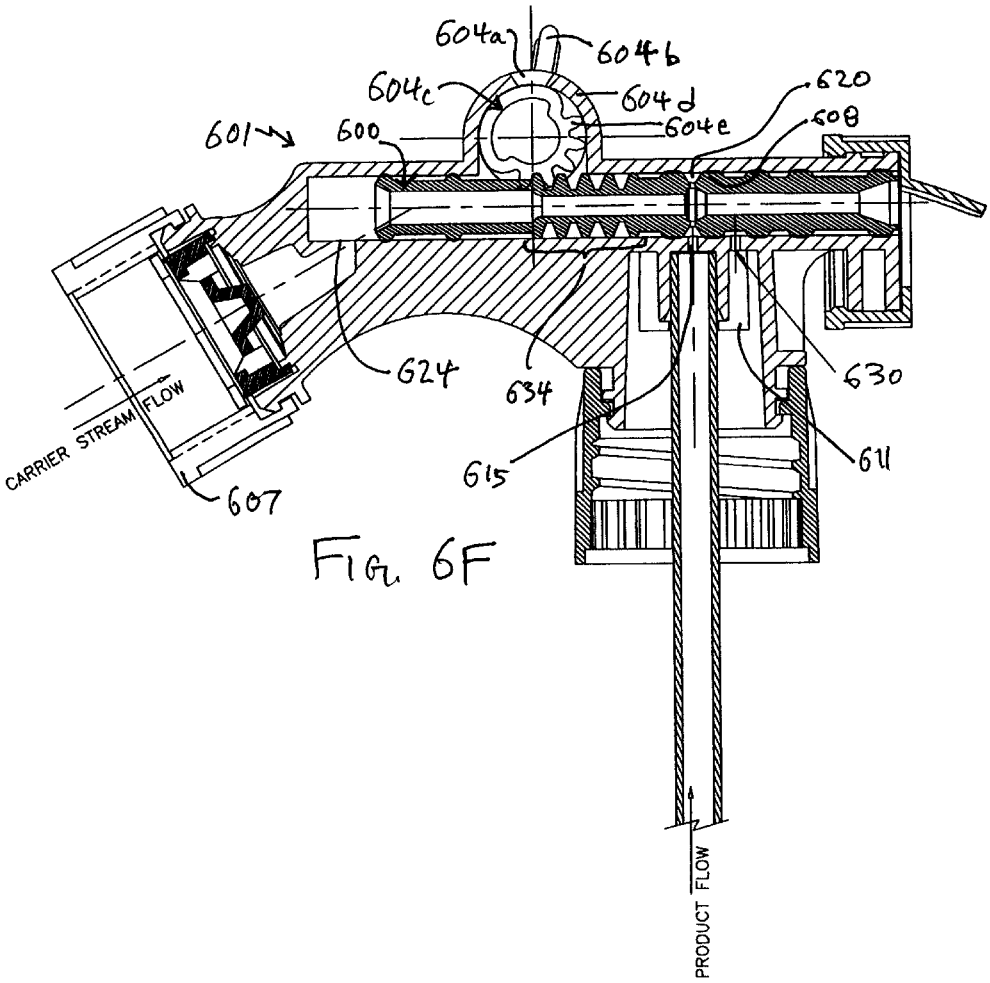

It is conceivable, in addition to affording the "MIX 1" and "MIX 2" ratios with the configurations shown in FIGS. 8C–8F, to additionally include a provision for a "water only" setting (similar to that afforded by the configuration of FIGS. 5C and 5D), simply by adding a fourth possible linear position of insert 800 that effectively blocks any introduction of product while permitting the introduction of water (again, in similar manner to the configuration shown in FIGS. 5C and 5D). Additional longitudinal positions of insert 800, of course, are also conceivable that might afford yet at least one additional selectable ratio of product-to-water.

As in the embodiment of FIGS. 4A–4F, a deflector element, indicated at 832, is preferably included and performs the same function as that indicated at 432 in FIGS. 4A–4F. Alternatively, however, the deflector element may be left out (as in the embodiment of FIGS. 5A–5F).

In recapitulation, it will be appreciated from the foregoing that at least one presently preferred embodiment of the present invention broadly contemplates a sliding elastomeric insert within a rigid outer tube, where the sliding action acts as both a carrier stream control valve and a product stream and product vent control valve. The sliding elastomeric insert provides an inner diameter, which is shaped to control the flow properties of the, carrier stream (e.g., water [such as from a garden hose]). It also preferably has a shaped outer diameter, which provides the required geometry for achieving pressure-tight seals as needed for containing the flow of the carrier stream and to control the product stream and the atmospheric vent to the product container.

Several variant embodiments, not specifically described hereinabove, are also contemplated within the scope of the present invention. It should be understood that the variant embodiments discussed herebelow may conceivably be undertaken alone or could, to the extent possible, be undertaken in combination with one or more other embodiments disclosed herein (including other variant embodiments disclosed herebelow).

In one variant embodiment, the sliding elastomeric insert can be powered by a lever action which is meshed with a cam surface molded onto the interior of the tubular housing.

In another variant embodiment, the sliding elastomeric insert can be powered by a lever action, wherein the aforementioned cam surfaces are included, and which mate with cam followers molded onto the exterior of sliding elastomeric insert. The cam followers could alternatively be separate pieces attached to the sliding elastomeric insert.

For another variant embodiment, the insert can be powered by a thread between the insert and the inside diameter of the outer tube, where rotation of the insert would cause the insert to be moved along the axis of the thread.

For yet another variant embodiment, there may be provided the capability to digitally control the flow of the carrier stream to provide: a) no carrier stream flow (off), b) carrier stream flow only (rinse), c) product flow diluted into carrier stream at a given ratio (product A), and d) additional linear positions (of the sliding elastomeric tube) for product flow diluted into carrier stream at differing ratios (product B, C, . . . n) according to the linear position of the control arrangement (e.g., insert). In each instance where product flow is generated, the vent to the product container is simultaneously opened to allow the product to be exposed to atmospheric pressure within the container.

In another variant embodiment, the insert can be powered linearly by a direct push/pull by the user and rotationally by a direct rotation of the inner tube by the user.

In yet another variant embodiment, where the insert can be powered linearly by a lever action which is meshed with a concentric cam surface molded onto the interior of the tubular housing and rotationally by direct rotation of the insert by the user. No drawings at this time.

For another variant embodiment, a control arrangement may have the capability to digitally control the flow of the carrier stream to provide a) no carrier stream flow (off), b) carrier stream flow only (rinse), c) product flow diluted into carrier stream at a given ratio (product A), and d) additional positions for product flow diluted into carrier stream at differing ratios (product B, C, . . . n) according to a rotational position of the control arrangement (e.g., insert) and a linear position of the same (e.g., there could be three linear positions for product delivery, along with four rotational positions—giving a total of 12 possible combinations of product-to-carrier stream ratios). In each instance where product flow is generated, the vent to the product container is simultaneously opened to allow the product to be exposed to atmospheric pressure within the container.

For yet another variant embodiment, the sliding action can act as carrier stream control valve. Additionally, the insert could be rotated on axis to multiple positions to control the flow of product and to control the atmospheric vent to the product container. This rotational control arrangement could include an "OFF" position, wherein the flow of product from the container and the atmospheric vent to the container are both closed to prevent leakage during storage of the product within the container. The rotational control arrangement allows for differing flow rates of product, when the inner tube is rotationally positioned in one of the product flow positions. This additional control permits one to achieve various product dilution ratios (or no product flow, as in a rinse application) with the carrier stream.

In another variant embodiment, it is possible to configure the insert such that it does not reciprocate longitudinally and, in fact, assumes a fixed longitudinal position while, possibly, allowing for rotational adjustment of the insert to afford a predetermined state (e.g., water only, product only, off).

In yet another variant embodiment, it is conceivable to employ a product container that does not have a delivery tube and atmospheric vent hole (such as that indicated at 430 in FIG. 4B). Instead, it is conceivable to utilize a collapsible bag of product. This bag could be disposed in a container which is in fluid communication with a hose connection. Thus, as water progresses into the container, it essentially squeezes product from the collapsible bag upwardly into the insert. This type of embodiment would appear to be particularly suitable if it is desired not to mix water with product.

For another variant embodiment, a significantly long insert such as that described hereinabove might be configured to afford the capability of accepting product from two adjacent containers, each perhaps containing different types of product or different concentrations thereof. In such a configuration, appropriate orifices could be provided in the insert in the vicinity of both containers. Different linear positions of the insert could afford the delivery of water only, admission of one product (with water), admission of the other product (with water), and admission of both products (with water). For such an embodiment, an extension of the embodiment shown in FIGS. 4A–4F, for instance, might be contemplated whereby a significantly long insert exhibits essentially the same configuration and geometry at two different places along the length of the insert.

From the foregoing, it will be appreciated that, in accordance with at least one presently preferred embodiment of the present invention, an "off-axis" hose connection is contemplated, as illustrated in each of FIGS. 3–6F, 7A, 7C, 7E, 7G, 7J, 7L and 8A–8F. In each case, a hose connection (such as the one indicated at 207 in FIG. 3) is oriented in such a way that it serves to provide a carrier stream flow that is at an angle with respect to that provided by a tubular portion (such as that indicated at 213 in FIG. 13). Conceivably any angle, and preferably an acute angle other than zero degrees (thus, up to and including about ninety degrees), may be employed in this vein, though the aforementioned figures illustrate an angle of about 30° (of the carrier stream flow provided by a hose connection with respect to the longitudinal axis of the tubular portion). Such an arrangement stands in stark contrast to conventional arrangements, in which a hose connection may typically provide a carrier stream flow that is parallel and coaxial with respect to the longitudinal axis of a tubular portion. Among to the advantages to be enjoyed by an "off-axis" hose connection as contemplated herein is a more relaxed (and possibly more "ergonomic") grip for a human hand, with the result that greater comfort would appear to be provided for an individual gripping the hose sprayer apparatus.

In accordance with at least one embodiment of the present invention, the arrangements described and illustrated herein may be utilized in connection with a "no-clog" sprayer apparatus such as that disclosed in U.S. Pat. No. 5,372,310 to E. Lee Ketcham, which patent is hereby fully incorporated by reference as if set forth in its entirety herein. Therein, a "no-clog" sprayer apparatus is described and illustrated with respect to FIG. 21 of the patent in question. Such a "no-clog" sprayer apparatus involves the employment of soluble solids, such as wettable powders, in a container whereby a portion of the water or other liquid delivered through a hose connection is diverted into the container so as to wet the solids in the container.

Figure 9:
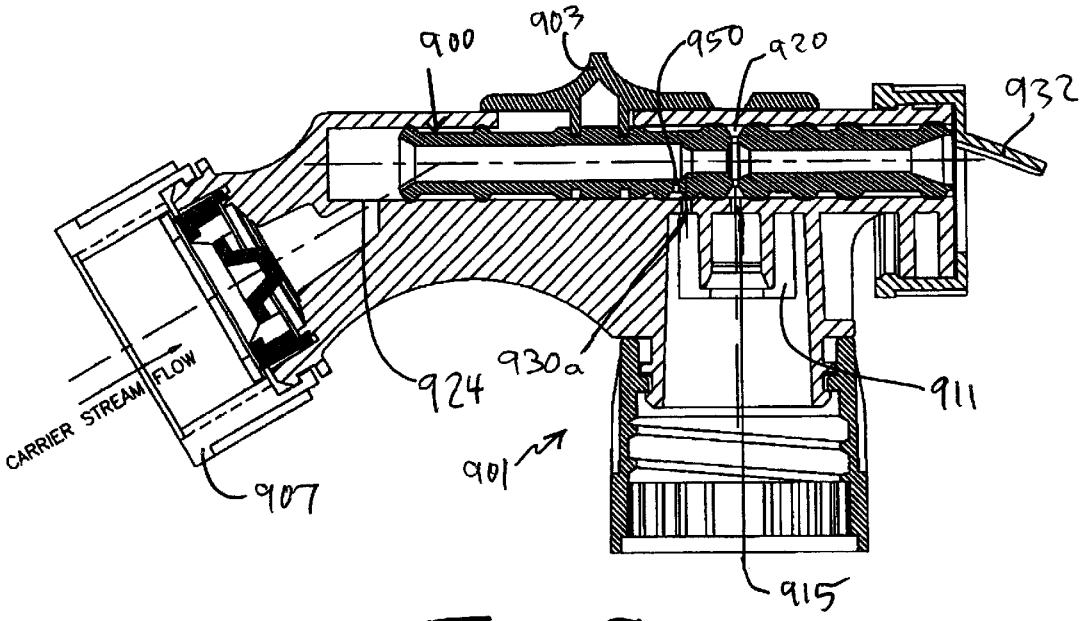
FIG. 9 is a side view of a valve body assembly embodiment similar to that shown in FIG. 8B, but with a variant insert embodiment.

A conceivable working embodiment of a "no-clog" arrangement in accordance with the present invention is illustrated in FIG. 9. Similar components with respect to FIGS. 8A–8F bear reference numerals advanced by 100. As shown, a port 930*a* could be in communication with an outlet 950 (positioned, in the direction of carrier stream flow, before the. "venturi" constriction) to provide a partial carrier stream (e.g., water) flow into a container. The mixture of water and dry product could then proceed through port 915 to annular chamber 920. The relative longitudinal position of insert 900 in FIG. 9 is such that a state of "MIX" is achieved; it will be appreciated that, as tube 900 is moved to the left towards the "$H_2O$" and "OFF" positions, outlet 950 will move away from port 930*a*.

Figure 10:
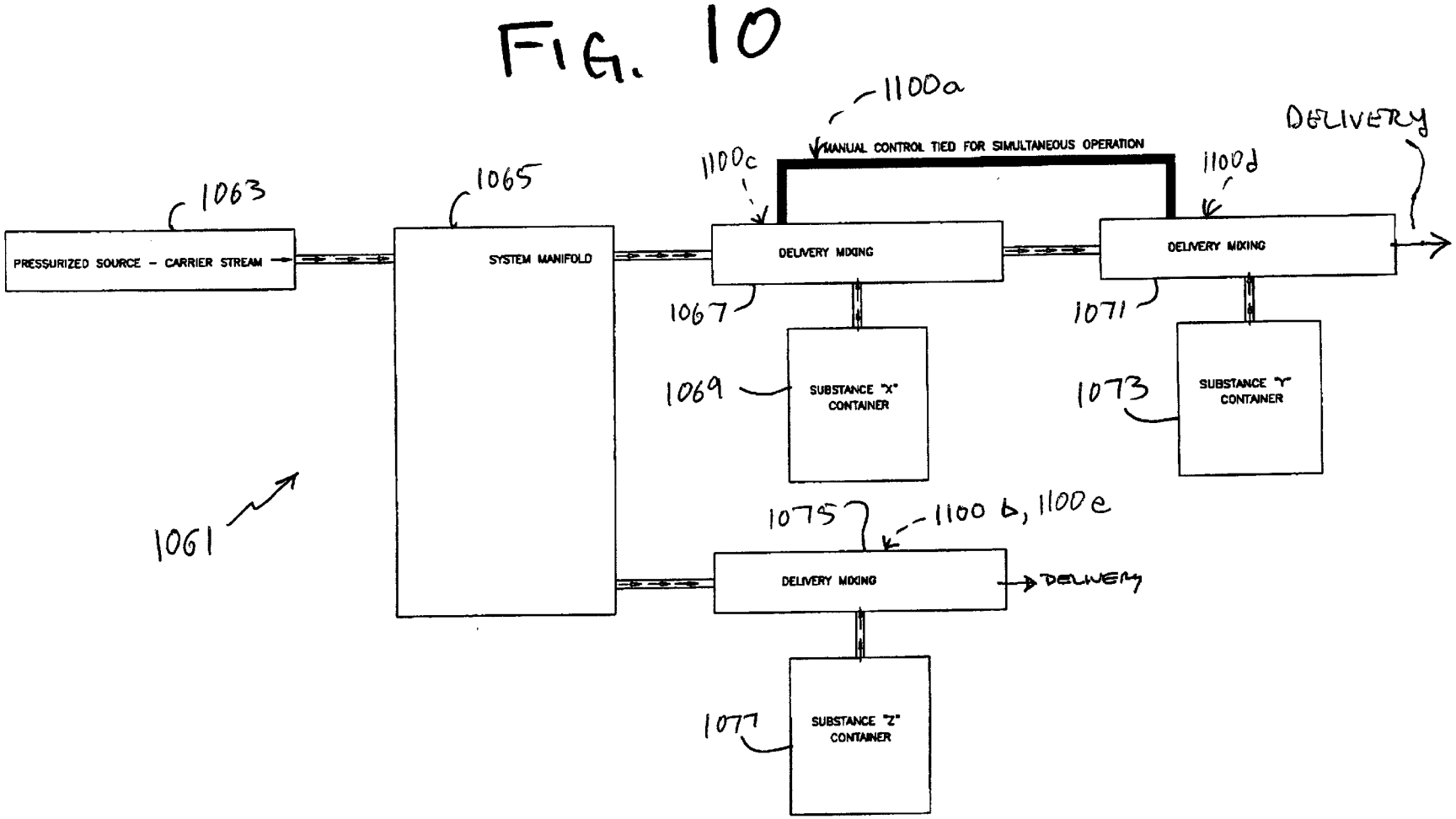
FIG. 10 is a schematic block diagram of a chemical mixing manifold arrangement.

FIG. 10 illustrates a chemical mixing manifold arrangement that may employ an insert in accordance with at least one embodiment of the present invention. Chemical manifold arrangements, configured for mixing one or more chemicals with a carrier stream (such as water) are generally well-known. It is hereby contemplated that an insert, substantially similar to the types disclosed and contemplated heretofore, may be utilized in the type of environment illustrated in FIG. 10.

As shown, a pressurized source 1063 for providing a carrier stream (such as water) may be adapted to deliver a carrier stream to a system manifold 1065. This manifold may then bifurcate the carrier stream, a first branch of which may proceed to a delivery mixing arrangement 1067, itself configured for accepting a substance "X", such as a chemical substance, from a container 1069. From delivery mixing arrangement 1067, the carrier stream, with or without the addition of substance "X", may proceed to a second delivery mixing arrangement 1071 that itself may be configured for accepting a substance "Y", such as a chemical substance, from a container 1073. Further delivery of the stream may then proceed, e.g., to a bucket.

A second branch of the carrier stream originally provided by source 1063 and bifurcated by manifold 1065 may proceed to another delivery mixing arrangement 1075, which itself may accept a substance "Z", such as a chemical substance, from container 1077. The stream may then proceed onward, e.g., to a bucket.

In the general vicinity of location 1100*a*, a thumb switch or other suitable actuator may preferably be provided to longitudinally displace two different inserts 1100*c*/1100*d*, substantially similar to the inserts described and contemplated heretofore, and located respectively at delivery arrangement 1067 and delivery arrangement 1071, such that the admission of a carrier stream and of one or more of the substances X and Y may be controlled in a manner similar to that described heretofore in connection with at least one embodiment of the present invention. Thus, the common actuator at 1100*a* may preferably move, simultaneously and in tandem, inserts at 1100*c* and 1100*d* to achieve, for instance, an "OFF" state (whereby no carrier stream proceeds past delivery mixing arrangement 1067), an "$H_2O$" state (whereby only the carrier stream, such as water, eventually proceeds out from delivery mixing arrangement 1071) and a "MIX" state, whereby substances X and Y respectively mix with the carrier stream in delivery mixing arrangements 1067 and 1071.

Similar principles may be employed via a single actuator at 1100*b* and single insert at 1100*e* whereby the actuator at 1100*b* may preferably move the insert at 1100*e* to achieve, for instance, an "OFF" state (whereby no carrier stream proceeds past delivery mixing arrangement 1075), an "$H_2O$" state (whereby only the carrier stream, such as water, eventually proceeds out from delivery mixing arrangement 1075) and a "MIX" state, whereby substance Z mixes with the carrier stream in delivery mixing arrangement 1075.

It is to be appreciated that an insert such as that described heretofore in connection with any and all embodiments may be utilized in essentially any suitable, foreseeable environment, including an environment other than those disclosed such that, in essentially any type of conceivable or foreseeable substance delivery apparatus that includes at least one inlet for accepting at least one substance and at least one outlet for permitting delivery of the at least one substance, there may be an adjustment element for regulating flow of the at least one substance between the at least one inlet and the at least one outlet, wherein the adjustment element is displaceable between at least a first position, corresponding to a first delivery condition of the at least one substance, and a second position, corresponding to a second delivery condition of the at least one substance, and wherein the adjustment element comprises at least one sealing element for facilitating airtight fluid communication in association with at least one of the first and second delivery conditions.

If not otherwise stated herein, it may be, assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

Although the invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

What is claimed is:

1. A substance delivery apparatus comprising:

at least one inlet for accepting at least one substance;

at least one outlet for permitting delivery of said at least one substance; and an adjustment element for regulating flow of the at least one substance between said at least one inlet and said at least one outlet;

said adjustment element being displaceable between at least a first position, corresponding to a first delivery condition of the at least one substance, and a second position, corresponding to a second delivery condition of the at least one substance;

said adjustment element comprising at least one sealing element for facilitating airtight fluid communication in association with at least one of said first and second delivery conditions;

said adjustment element being further displaceable to a third position, corresponding to a third delivery condition of the at least one substance; and said substance delivery apparatus further comprising a longitudinal actuator for slidably displacing said adjustment element.

2. The substance delivery apparatus according to claim 1, wherein said adjustment element comprises an elongated elastomeric element.

3. The substance delivery apparatus according to claim 1, wherein said at least one sealing element is formed integrally with respect to said adjustment element.

4. The substance delivery apparatus according to claim 3, wherein:

said adjustment element comprises a generally cylindrical main body; and said at least one sealing element comprises at least one annular protrusion disposed about and protruding from said main body.

5. The substance delivery apparatus according to claim 1, wherein said at least one inlet includes a first inlet adapted to accept a first substance and a second inlet adapted to accept a second substance.

6. The substance delivery apparatus according to claim 5, wherein:

said first delivery condition corresponds to delivery of neither of the first and second substances through said at least one outlet; and said second delivery condition corresponds to delivery of solely the first substance through said at least one outlet.

7. The substance delivery apparatus according to claim 6, wherein said third delivery condition corresponds to delivery of a mixture of the first and second substances through said at least one outlet.

8. The substance delivery apparatus according to claim 5, wherein said first inlet is adapted to engage in fluid communication with a hose connection.

9. The substance delivery apparatus according to claim 5, wherein:

said substance delivery apparatus comprises a cap member;

said cap member is adapted to engage with a container of the second substance;

said cap member includes a port for permitting flow of the second substance out of the container of the second substance; and said second inlet is adapted to engage in fluid communication with said port.

10. The substance delivery apparatus according to claim 1, further comprising a deflector element disposed adjacent said at least one outlet, for deflecting the at least one substance during delivery of the at least one substance.

11. The substance delivery apparatus according to claim 1, further comprising a rotating actuator for rotationally displacing said adjustment element.

12. The substance delivery apparatus according to claim 11, wherein:

said longitudinal actuator is adapted to displace said adjustment element between at least the first and second positions; and said rotating actuator is adapted to displace said adjustment element rotationally when said longitudinal actuator is in one of said first and second positions.

13. The substance delivery apparatus according to claim 12, wherein:

said at least one inlet comprises a first inlet and at least two additional inlets;

said first inlet being adapted to accept a first substance;

said at least two additional inlets being adapted to accept a second substance.

14. The substance delivery apparatus according to claim 13, wherein said rotational actuator is adapted to rotate said adjustment element between at least said first position, corresponding to a condition in which a first of said at least two additional inlets is adapted to accept the second substance, and said second position, corresponding to a condition in which a second of said at least two additional inlets is adapted to accept the second substance.

15. The substance delivery apparatus according to claim 14, wherein said at least two additional inlets are sized differently.

16. The substance delivery apparatus according to claim 1, wherein:

said adjustment element is further displaceable to a fourth position, corresponding to a fourth delivery condition of the at least one substance;

said at least one inlet includes a first inlet adapted to accept a first substance and a second inlet adapted to accept a second substance;

said first delivery condition corresponds to delivery of neither of the first and second substances through said at least one outlet;

said second delivery condition corresponds to delivery of solely the first substance through said at least one outlet;

said third delivery condition corresponds to delivery of a mixture of the first and second substances through said at least one outlet in accordance with a first ratio of the first and second substances with respect to one another; and said fourth delivery condition corresponds to delivery of a mixture of the first and second substances through said at least one outlet in accordance with a second ratio of the first and second substances with respect to one another, the second ratio being different from the first ratio.

17. The substance delivery apparatus according to claim 1, further comprising:

a main body portion for containing said adjustment element;

said longitudinal actuator being slidably mounted on said main body portion and being connected with said adjustment element.

18. The substance delivery apparatus according to claim 1, wherein:

said at least one inlet includes a first inlet adapted to accept a first substance;

said substance delivery apparatus further includes:

a cap member adapted to engage with a container which contains a second substance and which is adapted for permitting mixing of the first substance with the second substance; and an arrangement for providing communication between said first inlet and the cap member, to thereby promote the admission of at least a portion of the first substance into the container and thus the mixing of the first and second substances in the container; and said at least one inlet further includes a second inlet for accepting such a mixture of the first and second substances from the container.

19. The substance delivery apparatus according to claim 1, further comprising:

a main body portion;

said at least one inlet comprising a first inlet for accepting a first substance and a second inlet for accepting a second substance;

said main body portion comprising said first inlet, said second inlet and said at least one outlet;

a hose connection in fluid communication with said first inlet, said hose connection being adapted to engage in fluid communication with a hose;

said hose connection being adapted to provide a flow of the first substance that generally runs at an angle with respect to a longitudinal axis of said main body portion, said angle being greater than zero degrees, whereby in one of said first and second delivery conditions said adjustment element blocks said first inlet to impede acceptance of the first substance.

20. The substance delivery apparatus according to claim 19, wherein said angle is less than or equal to about ninety degrees.

21. The substance delivery apparatus according to claim 20, wherein said angle is between about fifteen and about forty-five degrees.

22. The substance delivery apparatus according to claim 21, wherein said angle is about thirty degrees.

23. A substance delivery apparatus comprising:

at least one inlet for accepting at least one substance;

at least one outlet for permitting delivery of said at least one substance;

an adjustment element for regulating flow of the at least one substance between said at least one inlet and said at least one outlet;

said adjustment element being displaceable between at least a first position, corresponding to a first delivery condition of the at least one substance, and a second position, corresponding to a second delivery condition of the at least one substance;

said adjustment element comprising at least one sealing element for facilitating airtight fluid communication in association with at least one of said first and second delivery conditions;

a longitudinal actuator for slidably displacing said adjustment element; and a rotating actuator for rotationally displacing said adjustment element.

24. The substance delivery apparatus according to claim 23, wherein:

said longitudinal actuator is adapted to displace said adjustment element between at least the first and second positions; and said rotating actuator is adapted to displace said adjustment element rotationally when said longitudinal actuator is in one of said first and second positions.

25. The substance delivery apparatus according to claim 24, wherein:

said at least one inlet comprises a first inlet and at least two additional inlets;

said first inlet being adapted to accept the first substance;

said at least two additional inlets being adapted to accept the second substance.

26. The substance delivery apparatus according to claim 25, wherein said rotational actuator is adapted to rotate said adjustment element between at least said position, corresponding to a condition in which a first of said at least two additional inlets is adapted to accept the second substance, and said second position, corresponding to a condition in which a second of said at least two additional inlets is adapted to accept the second substance.

27. The substance delivery apparatus according to claim 26, wherein said at least two additional inlets are sized differently.

28. A substance delivery apparatus comprising:

at least one inlet for accepting at least one substance;

at least one outlet for permitting delivery of said at least one substance; and an adjustment element for regulating flow of the at least one substance between said at least one inlet and said at least one outlet;

said adjustment element being displaceable between at least a first position, corresponding to a first delivery condition of the at least one substance, and a second position, corresponding to a second delivery condition of the at least one substance;

said adjustment element comprising at least one sealing element for facilitating airtight fluid communication in association with at least one of said first and second delivery conditions;

said adjustment element being further displaceable to a third position, corresponding to a third delivery condition of the at least one substance, and a fourth position, corresponding to a fourth delivery condition of the at least one substance;

said at least one inlet includes a first inlet adapted to accept a first substance and a second inlet adapted to accept a second substance;

said first delivery condition corresponds to delivery of neither of the first and second substances through said at least one outlet;

said second delivery condition corresponds to delivery of solely the first substance through said at least one outlet;

said third delivery condition corresponds to delivery of a mixture of the first and second substances through said at least one outlet in accordance with a first ratio of the first and second substances with respect to one another; and said fourth delivery condition corresponds to delivery of a mixture of the first and second substances through said at least one outlet in accordance with a second ratio of the first and second substances with respect to one another, the second ratio being different from the first ratio.

* * * * *